US012559808B2

(12) United States Patent
Yabu et al.

(10) Patent No.: US 12,559,808 B2
(45) Date of Patent: Feb. 24, 2026

(54) HOT ROLLED STEEL SHEET

(71) Applicant: NIPPON STEEL CORPORATION, Tokyo (JP)

(72) Inventors: Shohei Yabu, Tokyo (JP); Kazumasa Tsutsui, Tokyo (JP); Takuya Kuwayama, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 530 days.

(21) Appl. No.: 18/007,621

(22) PCT Filed: Jul. 9, 2021

(86) PCT No.: PCT/JP2021/025901
§ 371 (c)(1),
(2) Date: Dec. 1, 2022

(87) PCT Pub. No.: WO2022/091489
PCT Pub. Date: May 5, 2022

(65) Prior Publication Data

US 2023/0304112 A1 Sep. 28, 2023

(30) Foreign Application Priority Data

Oct. 28, 2020 (JP) ..... 2020-180729

(51) Int. Cl.

| | |
|---|---|
| ***C21D 9/46*** | (2006.01) |
| ***C21D 8/0221*** | (2026.01) |
| ***C22C 38/00*** | (2006.01) |
| ***C22C 38/02*** | (2006.01) |
| ***C22C 38/04*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |

(52) U.S. Cl.
CPC ..... *C21D 8/0226* (2013.01); *C21D 9/46* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 2211/005* (2013.01)

(58) Field of Classification Search
CPC ..... C21D 9/46
See application file for complete search history.

(56) References Cited

U.S. PATENT DOCUMENTS

| | | | | |
|---|---|---|---|---|
| 2006/0191612 | A1* | 8/2006 | Yoshida | C22C 38/12 148/603 |
| 2014/0000769 | A1 | 1/2014 | Takahashi et al. | |
| 2015/0203949 | A1 | 7/2015 | Yokoi et al. | |
| 2019/0177822 | A1 | 6/2019 | Maeda et al. | |

FOREIGN PATENT DOCUMENTS

| | | | |
|---|---|---|---|
| WO | WO 2012/128228 | A1 | 9/2012 |
| WO | WO 2014/051005 | A1 | 4/2014 |
| WO | WO 2018/033990 | A1 | 2/2018 |

OTHER PUBLICATIONS

Naik et al., "Texture-Based Metallurgical Phase Identification in Structural Steels: A Supervised Machine Learning Approach", Metals, 2019, vol. 9, No. 546, total 13 pages.
Webel et al., "A new analysis approach based on Haralick texture features for the characterization of microstructure on the example of low-alloy steels", Materials Characterization, 2018, vol. 144, pp. 584-596.
Zuiderveld, Contrast Limited Adaptive Histogram Equalization, Chapter VIII.5, Graphics Gems IV. P.S. Heckbert (Eds.), Cambridge, MA, Academic Press, 1994, pp. 474-485.

* cited by examiner

*Primary Examiner* — Jophy S. Koshy
(74) *Attorney, Agent, or Firm* — Birch, Stewart, Kolasch & Birch, LLP

(57) ABSTRACT

This hot roiled steel sheet has a predetermined chemical composition, in which the microstructure contains, by area %, polygonal ferrite: 2.0% or more and less than 10.0% and the remainder in the microstructure: more than 90.0% and 98.0% or less, and a correlation value that is obtained by analyzing the remainder in the microstructure in a SEM image of the microstructure is 0.82 to 0.95, and a maximum probability value is 0.0040 to 0.0200.

6 Claims, No Drawings

HOT ROLLED STEEL SHEET

TECHNICAL FIELD OF THE INVENTION

The present invention relates to a hot rolled steel sheet.

Priority is claimed on Japanese Patent Application No. 2020-180729, filed in Japan on Oct. 28, 2020, the content of which is incorporated herein by reference.

BACKGROUND ART

In recent years, from the viewpoint of protecting the global environment, efforts have been made to reduce the amount of carbon dioxide gas emitted in many fields. Vehicle manufacturers are also actively developing techniques for reducing the weight of vehicle bodies for the purpose of reducing fuel consumption. However, it is not easy to reduce the weight of vehicle bodies since the emphasis is placed on improvement in collision resistance to secure the safety of the occupants.

In order to achieve both vehicle body weight reduction and collision resistance, an investigation has been conducted to make a member thin by using a high strength steel sheet. Therefore, there is a strong demand for a steel sheet having both high strength and excellent workability, and several techniques have been conventionally proposed to meet this demand. Since there are various working methods for vehicle members, the required formability differs depending on members to which the working methods are applied, but among these, ductility and bendability are placed as important indices for workability.

As steel sheets having both a high strength and excellent workability, dual phase steel sheets (DP steel sheets) composed of a composite structure of soft ferrite and full hard martensite and TRIP steel sheets for which transformation induced plasticity (TRIP) is used have been conventionally proposed.

For example, Patent Document 1 discloses a hot rolled steel sheet having a microstructure containing ferrite and martensite and being excellent in terms of strength, elongation, and hole expansibility, in which, in the microstructure, by area %, ferrite is 90% to 98%, martensite is 2% to 10%, bainite is 0% to 3%, and pearlite is 0% to 3%. DP steel sheets and TRIP steel sheets have a low yield ratio and thus may not be applicable to automobile suspension parts where higher impact strength and fatigue strength are required.

In general, to automobile suspension parts, steel sheets composed of a composite structure of ferrite and bainite, for which precipitation hardening is used are applied. For example, Patent Document 2 discloses a high-burring workability and high-strength composite structure steel sheet having a tensile strength of 540 MPa or more and being excellent in terms of surface properties and notch fatigue properties, in which a primary phase of the microstructure is composed of polygonal ferrite precipitation-hardened by a Ti carbide, a second phase is a composite structure composed of a low temperature transformation product that is 1% to 10% in terms of an area fraction (fsd (%)) and dispersed as a plurality of structures.

However, in the steel sheets as described above, sufficient toughness may not be obtained in a case where the tensile strength is set to 780 MPa or more. In addition, in steel sheets where the Si content is increased in order for high-strengthening, a scale pattern may remain even in a case where scale has been removed, and the external appearance of the steel sheets may deteriorate.

In addition, Patent Document 3 discloses a hot rolled steel sheet in which a microstructure contains ferrite as a primary phase, at least one of martensite and residual austenite as a second phase, and a plurality of inclusions, and the sum of the lengths in the rolling direction of a group of inclusions having a length of 30 μm or more in the rolling direction and independent inclusions having a length of 30 μm or more in the rolling direction is 0 mm or more and 0.25 mm or less per 1 $mm^2$.

However, in the technique described in Patent Document 3, the toughness at low temperatures is insufficient, and there is a need to further improve the toughness at low temperatures in order to make it possible to sufficiently suppress fracture during use in cold regions and during impact.

PRIOR ART DOCUMENT

Patent Document

[Patent Document 1] PCT International Publication No. WO2018/033990

[Patent Document 2] PCT International Publication No. WO 2014/051005

[Patent Document 3] PCT International Publication No. WO 2012/128228

Non-Patent Document

[Non-Patent Document 1]J. Webel, J. Gola, D. Britz, F. Mucklich, Materials Characterization 144 (2018) 584-596

[Non-Patent Document 2]D. L. Naik, H. U. Sajid, R. Kiran, Metals 2019, 9, 546

[Non-Patent Document 3]K. Zuiderveld, Contrast Limited Adaptive Histogram Equalization, Chapter VIII. 5, Graphics Gems IV. P. S. Heckbert (Eds.), Cambridge, MA, Academic Press, 1994, pp. 474-485

DISCLOSURE OF THE INVENTION

Problems to be Solved by the Invention

The present invention has been made in view of the above circumstances. An object of the present invention is to provide a hot rolled steel sheet having high strength and yield ratio and being excellent in terms of ductility, bendability, toughness, and external appearance.

Means for Solving the Problem

The gist of the present invention is as described below.

(1) A hot rolled steel sheet according to an aspect of the present invention containing, by mass %, as a chemical composition:

C: 0.025% to 0.055%,
Mn: 1.00% to 2.00%,
sol. Al: 0.200% or more and less than 0.500%,
Ti: 0.030% to 0.200%,
Si: 0.100% or less,
P: 0.100% or less,
S: 0.030% or less,
N: 0.100% or less,
O: 0.010% or less,
Nb: 0% to 0.050%,
V: 0% to 0.050%,
Cu: 0% to 2.00%,
Cr: 0% to 2.00%'
Mo: 0% to 1.000%, Ni: 0% to 2.00%,
B: 0% to 0.0100%,
Ca: 0% to 0.0200%,
Mg: 0% to 0.0200%,
REM: 0% to 0.1000%,
Bi: 0% to 0.0200%,
Zr: 0% to 1.000%,
Co: 0% to 1.000%,
Zn: 0% to 1.000%,
W: 0% to 1.000%,
Sn: 0% to 0.050%, and
a remainder: Fe and impurities,
in which a microstructure contains, by area %,
polygonal ferrite: 2.0% or more and less than 10.0%, and
a remainder in the microstructure: more than 90.0% and 98.0% or less, and
a correlation value represented by the following formula (1), which is obtained by analyzing the remainder in the microstructure in a SEM image of the microstructure by a gray-level co-occurrence matrix method, is 0.82 to 0.95, and a maximum probability value represented by the following formula (2) is 0.0040 to 0.0200.

$$\text{Correlation} = \sum_i \sum_j \frac{P(i, j)[(i-\mu_x)\cdot(j-\mu_y)]}{\sigma_x \sigma_y}, \quad (1)$$

$$\text{Maximum Probability} = \text{Max}(P(i, j)) \quad (2)$$

where P(i, j) in the formula (1) and the formula (2) is a gray-level co-occurrence matrix, and $\mu_x$, $\mu_y$, $\sigma_x$, and $\sigma_y$ are represented by the following formulas (3) to (6).

$$\mu_x = \sum_i \sum_j i(P(i, j)) \quad (3)$$

$$\mu_y = \sum_i \sum_j j(P(i, j)) \quad (4)$$

$$\sigma_x = \sum_i \sum_j P(i, j)(i-\mu_x)^2 \quad (5)$$

$$\sigma_y = \sum_i \sum_j P(i, j)(i-\mu_y)^2 \quad (6)$$

(2) The hot rolled steel sheet according to (1) may further contain, as the chemical composition, by mass %, one or more among the group consisting of
Nb: 0.001% to 0.050%,
V: 0.001% to 0.050%,
Cu: 0.01% to 2.00%,
Cr: 0.01% to 2.00%,
Mo: 0.001% to 1.000%,
Ni: 0.01% to 2.00%,
B: 0.0001% to 0.0100%,
Ca: 0.0001% to 0.0200%,
Mg: 0.0001% to 0.0200%,
REM: 0.00010% to 0.1000%,
Bi: 0.0001% to 0.0200%,
Zr: 0.001% to 1.000%,
Co: 0.001% to 1.000%,
Zn: 0.001% to 1.000%,
W: 0.001% to 1.000%, and
Sn: 0.001% to 0.050%.

(3) In the hot rolled steel sheet according to (1) or (2), the maximum probability value of the microstructure may be 0.0080 to 0.0200.

(4) In the hot rolled steel sheet according to any one of (1) to (3), the chemical composition may satisfy Si+[T-Al] <0.500% when a Si content by mass % is represented by Si, and an Al content by mass % is represented by [T-Al].

(5) In the hot rolled steel sheet according to any one of (1) to (4), a tensile strength may be 780 MPa or more, and
a yield ratio that is obtained by dividing a yield stress by the tensile strength may be 0.86 or more.

Effects of the Invention

According to the above-described aspect of the present invention, it is possible to provide a hot rolled steel sheet having high strength and yield ratio and being excellent in terms of ductility, bendability, toughness, and external appearance. In addition, according to the above-described preferable aspect of the present invention, it is possible to provide a hot rolled steel sheet having superior bendability.

EMBODIMENTS OF THE INVENTION

In view of the above problems, the present inventors repeated intensive studies on the chemical compositions of a hot rolled steel sheet and the relationship between a microstructure and mechanical properties. As a result, the present inventors found that a hot rolled steel sheet having high strength and yield ratio and being excellent in terms of ductility, bendability, toughness, and external appearance can be obtained by decreasing the Si content and providing a microstructure having a low temperature transformation structure with specific characteristics (bainitic ferrite).

Hereinafter, the chemical composition and microstructure of a hot rolled steel sheet according to the present embodiment will be more specifically described. However, the present invention is not limited only to a configuration disclosed in the present embodiment and can be modified in a variety of manners within the scope of the gist of the present invention.

The numerical limit range described below with "to" in between includes the lower limit and the upper limit. Numerical values expressed with "less than" or "more than" are not included in numerical ranges. In the following description, % regarding the chemical composition of the hot rolled steel sheet is mass % unless particularly otherwise specified.

1. Chemical Composition

The hot rolled steel sheet according to the present embodiment contains, by mass %, C: 0.025% to 0.055%, Mn: 1.00% to 2.00%, sol. Al: 0.200% or more and less than 0.500%, Ti: 0.030% to 0.200%, Si: 0.100% or less, P: 0.100% or less, S: 0.030% or less, N: 0.100% or less, O: 0.010% or less, and a remainder of Fe and impurities. Each element will be described in detail below.

C: 0.025% to 0.055%

C is an element required to obtain a desired strength. When the C content is less than 0.025%, a desired tensile strength cannot be obtained. Therefore, the C content is set to 0.025% or more. The C content is preferably 0.027% or more and more preferably 0.030% or more.

On the other hand, when the C content is more than 0.055%, the bendability and toughness of the hot rolled steel sheet deteriorate. Therefore, the C content is set to 0.055% or less. The C content is preferably 0.052% or less and more preferably 0.050% or less.

Mn: 1.00% to 2.00%

Mn is an element that suppresses ferritic transformation to increase the strength of the hot rolled steel sheet. When the Mn content is less than 1.00%, a desired tensile strength cannot be obtained. Therefore, the Mn content is set to 1.00% or more. The Mn content is preferably 1.20% or more and more preferably 1.30% or more.

On the other hand, when the Mn content is more than 2.00%, the bendability and toughness of the hot rolled steel sheet deteriorate. Therefore, the Mn content is set to 2.00% or less. The Mn content is preferably 1.90% or less and more preferably 1.70% or less or 1.60% or less.

sol. Al: 0.200% or More and Less than 0.500%

Al has an action of deoxidizing steel to make the steel sound (suppressing the generation of a defect such as blowholes in the steel) and also has an action of promoting the formation of a low temperature transformation structure with specific characteristics (bainitic ferrite) and enhancing the bendability and toughness of the hot rolled steel sheet. When the sol. Al content is less than 0.200%, an effect by the action cannot be obtained. Therefore, the sol. Al content is set to 0.200% or more. The sol. Al content is preferably 0.250% or more and more preferably 0.300% or more.

On the other hand, when the sol. Al content is 0.500% or more, the above effects are saturated, which is not economically preferable. In addition, when the sol. Al content is 0.500% or more, polygonal ferrite is excessively precipitated. Therefore, the sol. Al content is set to less than 0.500%. The sol. Al content is preferably 0.450% or less and more preferably 0.400% or less or 0.350% or less.

The sol. Al means acid-soluble Al and refers to solid solution Al present in steel in a solid solution state.

In the chemical composition of the hot rolled steel sheet according to the present embodiment, when the Si content by mass % is represented by Si, and the Al content by mass % is represented by [T-Al], Si+[T-Al]<0.500% may be satisfied. When Si+[T-Al]<0.500% is satisfied, the area ratio of polygonal ferrite can be stably set to 10% or less. In addition, the occurrence of slab cracking can be further reduced.

[T-Al]mentioned herein refers to the total content (mass %) of Al that is contained in the hot rolled steel sheet and is the sum of the acid-soluble Al (sol. Al) content and the content of a relatively small amount of acid-insoluble Al (insol. Al).

The [T-Al]content may be set to 0.200% to 0.500% as necessary. The upper limit thereof may be set to 0.450%, 0.400% or 0.350%, and the lower limit thereof may be set to 0.250% or 0.300%.

Ti: 0.030% to 0.200%

Ti is precipitated in steel as a carbide or a nitride and has an action of refining the microstructure by an austenite pinning effect and increasing the tensile strength of the hot rolled steel sheet by precipitation hardening. When the Ti content is less than 0.030%, a desired tensile strength cannot be obtained. Therefore, the Ti content is set to 0.030% or more. The Ti content is preferably 0.050% or more and more preferably 0.100% or more.

On the other hand, when the Ti content is more than 0.200%, the tensile strength of the hot rolled steel sheet deteriorates due to the excessive precipitation of polygonal ferrite. Therefore, the Ti content is set to 0.200% or less. The Ti content is preferably 0.180% or less and more preferably 0.150% or less.

Si: 0.100% or Less

Si has an action of improving the ductility of the hot rolled steel sheet by promoting the formation of ferrite and an action of increasing the strength of the hot rolled steel sheet by the solid solution strengthening of ferrite. In addition, Si has an action of making steel sound by deoxidation. However, when the Si content is more than 0.100%, scale is generated on the surface of the hot rolled steel sheet, and a scale pattern remains on the surface of the hot rolled steel sheet even in a case where the scale has been removed. As a result, the external appearance of the hot rolled steel sheet deteriorates. Therefore, the Si content is set to 0.100% or less. The Si content is preferably 0.080% or less and more preferably 0.050% or less.

The lower limit of the Si content does not need to be particularly specified, and the S content may be set to 0.010% or more.

P: 0.100% or Less

P is an element that is generally contained in steel as an impurity and has an action of increasing the strength of the hot rolled steel sheet by solid solution strengthening. Therefore, P may be positively contained. However, P is an element that is easily segregated, and, when the P content exceeds 0.100%, the deterioration of the bendability of the hot rolled steel sheet attributed to boundary segregation becomes significant. Therefore, the P content is set to 0.100% or less. The P content is preferably 0.050% or less and more preferably 0.030% or less.

The lower limit of the P content does not need to be particularly specified, and the P content may be set to 0.001% from the viewpoint of refining cost.

S: 0.030% or Less

S is an element that is contained in steel as an impurity. In addition, S is an element that forms a sulfide-based inclusion in steel to degrade the bendability of the hot rolled steel sheet. When the S content exceeds 0.030%, the bendability of the hot rolled steel sheet significantly deteriorates. Therefore, the S content is set to 0.030% or less. The S content is preferably 0.010% or less and more preferably 0.005% or less.

The lower limit of the S content does not need to be particularly specified, and the S content may be set to 0.0001% from the viewpoint of refining cost.

N: 0.100% or Less

N is an element that is contained in steel as an impurity and has an action of degrading the bendability of the hot rolled steel sheet. When the N content is more than 0.100%, the bendability of the hot rolled steel sheet significantly deteriorates. Therefore, the N content is set to 0.100% or less. The N content is preferably 0.080% or less, more preferably 0.070% or less, and still more preferably 0.010% or less or 0.006% or less.

The lower limit of the N content does not need to be particularly specified, and the N content may be set to 0.001% or more.

O: 0.010% or Less

When contained in steel in large quantities, O is an element that forms a coarse oxide that becomes the starting point of fracture and causes brittle fractures and hydrogen-induced cracks. When the O content is more than 0.010%, brittle fractures and hydrogen-induced cracks are likely to be initiated. Therefore, the O content is set to 0.010% or less. The O content is preferably 0.008% or less and more preferably 0.005% or less or 0.003% or less.

The O content may be set to 0.0005% or more or 0.001% or more in order to disperse a large number of fine oxides during the deoxidation of molten steel.

The hot rolled steel sheet according to the present embodiment may contain the following elements as optional elements instead of some of Fe. In a case where the above optional elements are not contained, the lower limit of the content thereof is 0%. Hereinafter, the optional elements will be described in detail.

Nb: 0% to 0.050%

Nb is an element that is finely precipitated in steel as a carbide and a nitride and improves the strength of steel by precipitation hardening. In order to reliably obtain this effect, the Nb content is preferably set to 0.001% or more.

However, when the Nb content is more than 0.050%, the bendability of the hot rolled steel sheet deteriorates. Therefore, the Nb content is set to 0.050% or less. The Nb content is preferably 0.030% or less and more preferably 0.020% or less or 0.010% or less. In order to cut the alloy cost, the Nb content may be set to 0.005% or less, 0.003% or less, or 0.001% or less as necessary.

V: 0% to 0.050%

V is, similar to Nb, an element that is finely precipitated in steel as a carbide and a nitride and improves the strength of steel by precipitation hardening. In order to reliably obtain this effect, the V content is preferably set to 0.001% or more.

However, when the V content is more than 0.050%, the bendability of the hot rolled steel sheet deteriorates. Therefore, the V content is set to 0.050% or less. The V content is preferably 0.030% or less and more preferably 0.020% or less or 0.010% or less. In order to cut the alloy cost, the V content may be set to 0.005% or less, 0.003% or less, or 0.001% or less as necessary.

Cu: 0% to 2.00%

Cu has an action of enhancing the hardenability of the hot rolled steel sheet and an action of being precipitated as a carbide in steel at a low temperature to increase the strength of the hot rolled steel sheet. In order to more reliably obtain the effect by these actions, the Cu content is preferably set to 0.01% or more.

However, when the Cu content is more than 2.00%, grain boundary cracking may occur in the slab. Therefore, the Cu content is set to 2.00% or less. The Cu content is preferably 1.00% or less and more preferably 0.60% or less or 0.30% or less. In order to cut the alloy cost, the Cu content may be set to 0.10% or less, 0.03% or less, or 0.01% or less as necessary.

Cr: 0% to 2.00%

Cr has an action of enhancing the hardenability of the hot rolled steel sheet. In order to more reliably obtain the effect by this action, the Cr content is preferably set to 0.01% or more.

However, when the Cr content is more than 2.00%, the chemical convertibility of the hot rolled steel sheet significantly deteriorates. Therefore, the Cr content is set to 2.00% or less. The Cu content is preferably 1.00% or less and more preferably 0.60% or less or 0.30% or less. In order to cut the alloy cost, the Cu content may be set to 0.10% or less, 0.03% or less, or 0.01% or less as necessary.

Mo: 0% to 1.000%

Mo has an action of enhancing the hardenability of the hot rolled steel sheet and an action of being precipitated as a carbide in steel to increase the strength of the hot rolled steel sheet. In order to more reliably obtain the effect by these actions, the Mo content is preferably set to 0.001% or more.

However, even when the Mo content is set to more than 1.000%, the effect by the actions is saturated, which is not economically preferable. Therefore, the Mo content is set to 1.000% or less. The Mo content is preferably 0.600% or less and more preferably 0.400% or less, 0.200% or less, 0.100% or less, or 0.030% or less. In order to cut the alloy cost, the Mo content may be set to 0.010% or less, 0.003% or less, or 0.001% or less as necessary.

Ni: 0% to 2.00%

Ni has an action of enhancing the hardenability of the hot rolled steel sheet. In order to more reliably obtain the effect by this action, the Ni content is preferably set to 0.010% or more and more preferably set to 0.02% or more.

However, since Ni is an expensive element, it is not economically preferable to contain a large amount of Ni. Therefore, the Ni content is set to 2.00% or less. The Ni content is preferably 1.00% or less and more preferably 0.60% or less or 0.30% or less. In order to cut the alloy cost, the Ni content may be set to 0.10% or less, 0.03% or less, or 0.01% or less as necessary.

B: 0% to 0.0100%

B has an action of enhancing the hardenability of the hot rolled steel sheet. In order to more reliably obtain the effect by this action, the B content is preferably set to 0.0001% or more.

However, when the B content is more than 0.0100%, the bendability of the hot rolled steel sheet significantly deteriorates. Therefore, the B content is set to 0.0100% or less. The B content is preferably 0.0050% or less and more preferably 0.0030% or less or 0.0020% or less. In order to cut the alloy cost, the B content may be set to 0.0010% or less, 0.0003% or less, or 0.0001% or less as necessary.

Ca: 0% to 0.0200%

Ca has an action of enhancing the bendability of the hot rolled steel sheet by adjusting the shape of an inclusion in steel to a preferable shape. In order to more reliably obtain the effect by this action, the Ca content is preferably set to 0.0001% or more and more preferably set to 0.0005% or more.

However, when the Ca content is more than 0.0200%, an inclusion is excessively formed in steel, and the bendability of the hot rolled steel sheet deteriorates. Therefore, the Ca content is set to 0.0200% or less. The Ca content is preferably 0.0100% or less and more preferably 0.0050% or less or 0.0020% or less. In order to cut the alloy cost, the B content may be set to 0.0010% or less, 0.0003% or less, or 0.0001% or less as necessary.

Mg: 0% to 0.0200%

Mg has an action of enhancing the bendability of the hot rolled steel sheet by adjusting the shape of an inclusion in steel to a preferable shape. In order to more reliably obtain the effect by this action, the Mg content is preferably set to 0.0001% or more and more preferably set to 0.0005% or more.

However, when the Mg content is more than 0.0200%, an inclusion is excessively formed in steel, and the bendability of the hot rolled steel sheet deteriorates. Therefore, the Mg content is set to 0.0200% or less. The Mg content is preferably 0.0100% or less and more preferably 0.0050% or less or 0.0020% or less. In order to cut the alloy cost, the B content may be set to 0.0010% or less, 0.0003% or less, or 0.0001% or less as necessary.

REM: 0% to 0.1000%

REM has an action of enhancing the bendability of the hot rolled steel sheet by adjusting the shape of an inclusion in steel to a preferable shape. In order to more reliably obtain the effect by this action, the REM content is preferably set to 0.0001% or more and more preferably set to 0.0005% or more.

However, when the REM content is more than 0.1000%, an inclusion is excessively formed in steel, and the bendability of the hot rolled steel sheet deteriorates. Therefore, the REM content is set to 0.1000% or less. The REM content is preferably 0.0100% or less and more preferably 0.0050% or less or 0.0020% or less. In order to cut the alloy cost, the REM content may be set to 0.0010% or less, 0.0003% or less, or 0.0001% or less as necessary.

Here, REM refers to a total of 17 elements consisting of Sc, Y, and lanthanoids, and the REM content refers to the total amount of these elements.

Bi: 0% to 0.0200%

In addition, Bi has an action of enhancing the bendability of the hot-rolled steel sheet by refining the solidification structure. In order to more reliably obtain the effect by this action, the Bi content is preferably set to 0.0001% or more and more preferably set to 0.0005% or more.

However, even when the Bi content is more than 0.0200%, the effect by the action is saturated, which is not economically preferable. Therefore, the Bi content is set to 0.0200% or less. The Bi content is preferably 0.0100% or less and more preferably 0.0050% or less or 0.0020% or less. In order to cut the alloy cost, the Bi content may be set to 0.0010% or less, 0.0003% or less, or 0.0001% or less as necessary.

Zr: 0% to 1.000%

Co: 0% to 1.000%

Zn: 0% to 1.000%

W: 0% to 1.000%

Sn: 0% to 0.050%

Regarding Zr, Co, Zn, and W, the present inventors have confirmed that, even when 1.000% or less of each of these elements is contained, the effect of the hot rolled steel sheet according to the present embodiment is not impaired. Therefore, the content of each of Zr, Co, Zn, and W may be set to 1.000% or less. The upper limit of the content of each of Zr, Co, Zn, and W is preferably 0.600% or less and more preferably 0.400% or less, 0.200% or less, 0.100% or less, or 0.030% or less. In order to cut the alloy cost, the content of each of Zr, Co, Zn, and W may be set to 0.010% or less, 0.003% or less, or 0.001% or less as necessary. The total content of Zr, Co, Zn, and W may be set to 1.000% or less, 0.100% or less, or 0.010% or less.

In addition, the present inventors have confirmed that, even when a small amount of Sn is contained, the effect of the hot rolled steel sheet according to the present embodiment is not impaired. However, when a large amount of Sn is contained, a defect may be generated during hot rolling, and thus the Sn content is set to 0.050% or less. The Sn content is preferably 0.030% or less and more preferably 0.020% or less. In order to cut the alloy cost, the Sn content may be set to 0.010% or less, 0.003% or less, or 0.001% or less as necessary.

The remainder of the chemical composition of the hot rolled steel sheet according to the present embodiment may be Fe and an impurity. In the present embodiment, the impurity means a substance that is incorporated from ore as a raw material, a scrap, manufacturing environment, or the like and/or a substance that is permitted to an extent that the hot rolled steel sheet according to the present embodiment is not adversely affected.

The chemical composition of the above hot-rolled steel sheet may be measured by a general analytical method. For example, the chemical composition may be measured using inductively coupled plasma-atomic emission spectrometry (ICP-AES). sol. Al may be measured by the ICP-AES using a filtrate after a sample is decomposed with an acid by heating. C and S may be measured by using a combustion-infrared absorption method, N may be measured by using the inert gas melting-thermal conductivity method, and O may be measured using an inert gas melting-non-dispersive infrared absorption method.

Microstructure of Hot Rolled Steel Sheet

Next, the microstructure of the hot rolled steel sheet according to the present embodiment will be described.

In the hot rolled steel sheet according to the present embodiment, the microstructure contains, by area %, polygonal ferrite: 2.0% or more and less than 10.0% and the remainder in the microstructure: more than 90.0% and 98.0% or less, and a correlation value represented by the following formula (1), which is obtained by analyzing the remainder in the microstructure in a SEM image of the microstructure by a gray-level co-occurrence matrix (GLCM) method, is 0.82 to 0.95, and a maximum probability value represented by the following formula (2) is 0.0040 to 0.0200.

In the present embodiment, the microstructural fractions, the correlation value, and the maximum probability value in the microstructure at a ¼ position of the sheet thickness and the center position in the sheet width direction in a cross section parallel to the rolling direction are specified. The reason therefor is that the microstructure at this position indicates a typical microstructure of the steel sheet. "¼ position of the sheet thickness" means a position separated from the surface by ¼ of the sheet thickness, which will be true below. The distance from the surface may slightly differ depending on the circumstances of test piece sampling as necessary, but is set within a range of a region from a ⅛ depth from the surface to a ⅜ depth from the surface.

Area ratio of polygonal ferrite: 2.0% or more and less than 10.0% Polygonal ferrite is a structure formed when fcc transforms into bcc at a relatively high temperature. Since polygonal ferrite has a low strength and is likely to deteriorate in toughness, when the area ratio thereof is excessive, desired tensile strength and toughness cannot be obtained. Therefore, the area ratio of polygonal ferrite is set to less than 10.0%. The area ratio of polygonal ferrite is preferably 9.0% or less or 8.0% or less and more preferably 7.0% or less or 6.0% or less.

In order to increase the yield ratio, the area ratio of polygonal ferrite is set to 2.0% or more. The area ratio of polygonal ferrite is preferably 3.0% or more and more preferably 4.0% or more or 4.5% or more.

Remainder in the Microstructure: More than 90.0% and 98.0% or Less

In the hot rolled steel sheet according to the present embodiment, in addition to polygonal ferrite, more than 90.0% and 98.0% or less of the remainder in the microstructure is contained. A specific remainder in the microstructure is 87.0% to 98.0% of bainitic ferrite and a total of 0% to 3.0% of "cementite, pearlite, fresh martensite, tempered martensite, and residual austenite" in terms of area ratio. The remainder in the microstructure formed of one or more structures of of bainitic ferrite, cementite, pearlite, fresh martensite, tempered martensite, and residual austenite has, unlike polygonal ferrite, a relatively high crystal orientation difference therein, and thus the GAM value to be described below becomes more than 0.4°. On the other hand, polygonal ferrite has a GAM value of 0.4° or less. Therefore, it is possible to easily distinguish polygonal ferrite and the remainder in the microstructure using the GAM value.

In the microstructure according to the present embodiment, it is also possible to set the area ratio of polygonal ferrite to 2.0% or more and less than 10.0%, the area ratio of bainitic ferrite to 87.0 to 98.0%, and the area ratio of other structures to 0% to 3.0%. In this case, the lower limit of the area ratio of bainitic ferrite may be set to 88.0%, 89.0%, 90.0%, or 91.0%, and the upper limit may be set to 97.0%, 96.0%, 95.0%, or 93.0%. The other structures are formed of one or more structures of bainitic ferrite, cementite, pearlite, fresh martensite, tempered martensite, and residual austenite. The upper limit of the area ratio of the other structures may be set to 2.5%, 2.0%, or 1.5%. The lower limit of the area ratio of the other structures is 0%, but may be set to 0.1%, 0.3%, or 0.6%.

The area ratio of each structure is obtained by the following method.

A sample is sampled from the hot rolled steel sheet such that a cross section parallel to a rolling direction at the ¼ position of the sheet thickness and the center position in the sheet width direction becomes an observed section. While also depending on a measurement device, the sample is set to a size where about 10 mm in the rolling direction can be observed. The cut-out cross section of the sample is polished using silicon carbide paper having a grit of #600 to #1500 and then finished as a mirror surface using liquid in which diamond powder having a grain size in a range of 1 μm to 6 μm is dispersed in a dilution solution, such as an alcohol, and pure water. Next, the cross section is polished for eight minutes at room temperature using colloidal silica containing no alkaline solution to remove strain introduced into the surface layer of the sample.

At the ¼ position of the sheet thickness from the surface of the cross section of the sample, a region that is 100 μm in the rolling direction and 100 μm in the sheet thickness direction is measured by the electron backscatter diffraction method at measurement intervals of 0.1 μm, thereby obtaining crystal orientation information. For the measurement, an EBSD analyzer composed of a thermal field emission scanning electron microscope (JSM-7001F manufactured by JEOL) and an EBSD detector (DVC5 type detector manufactured by TSL) is used. At this time, the degree of vacuum in the EBSD analyzer is set to $9.6\times10^{-5}$ Pa or less, the accelerating voltage is set to 15 kV, the irradiation current level is set to 13, and the irradiation time of the electron beam is set to 0.01 seconds/point.

In the obtained crystal orientation information, grains having an fcc crystal structure are determined as residual austenite using a "Phase Map" function installed in software "OIM Analysis (registered trademark)" included in the EBSD analyzer. In addition, in regions where the crystal structure is determined to be bcc, crystal grains surrounded by grain boundaries with an orientation difference of 15° or more are specified. For each of the specified crystal grains, whether the grain average misorientation (GAM value) is 0.4° or less or more than 0.4° is determined. The above-described operation is performed in at least five regions. Crystal grains with a GAM value of 0.4° or less are determined to be polygonal ferrite. The area ratio of polygonal ferrite is calculated using the total observed area as the denominator and the total area of polygonal ferrite as the numerator.

In addition, the area ratio of residual austenite is obtained by calculating the average value of the area ratios of regions determined to be residual austenite. For crystal grains with a GAM value of more than 0.4°, the correlation value (C value) and the maximum probability value are measured by a method to be described below.

For regions determined to be other than polygonal ferrite among the regions where the crystal structure is determined to be bcc, under a condition that a grain boundary having an orientation difference of 15° or more is defined as a grain boundary, the "grain average IQ" of the polygonal ferrite regions is calculated using a "Grain Average IQ" function installed in software "OIM Analysis (registered trademark)" included in the EBSD analyzer. When the maximum value is indicated by Iα, regions where the "grain average IQ" becomes Iα/2 or less are determined to be "cementite, pearlite, fresh martensite, and tempered martensite". The area ratio of these regions is calculated, thereby obtaining the total of the area ratios of "cementite, pearlite, fresh martensite, and tempered martensite".

The area ratio of bainitic ferrite is obtained by subtracting the area ratios of polygonal ferrite, residual austenite, and "cementite, pearlite, fresh martensite, and tempered martensite" obtained by the above-described method from 100%.

The area ratio of the remainder in the microstructure is obtained by calculating the sum of the area ratio of residual austenite, the area ratio of bainitic ferrite, and "cementite, pearlite, fresh martensite, and tempered martensite" obtained by the above-described method.

Bainitic ferrite is a structure almost all of which is determined to be bainite in a case where the structure is observed with an optical microscope. In a case where the microstructure of the hot rolled steel sheet according to the present embodiment is observed with an optical microscope, at least 80% or more of bainite is observed in terms of area ratio. The structure is observed with an optical microscope by, for example, the following method. A sample for structure observation is cut out such that a sheet thickness cross section parallel to the rolling direction becomes an observed section, and the observed section is mirror-polished. Nital etching is performed on the mirror-polished sample, and then the structure is observed.

Correlation Value (C Value): 0.82 to 0.95

Maximum Probability Value (M Value): 0.0040 to 0.0200

In order to obtain high strength and yield ratio and excellent ductility, bendability, and toughness, it is important to make the microstructure low in non-uniformity and high in uniformity between crystal grains. In the present embodiment, a correlation value (hereinafter, also referred to as C value) is adopted as an index of non-uniformity between extremely small regions of the microstructure, and a maximum probability value (hereinafter, also referred to as M value) is adopted as an index of uniformity of the entire microstructure.

The C value represents the non-uniformity within a crystal grain of the microstructure. In a case where points separated in the submicron order in a crystal grain are non-uniform, the C value improves. In the present embodiment, since there is a need to make the microstructure have bainitic ferrite having fine subgrain boundaries or precipitates in crystal grains, it is necessary to control the C value to a desired value. When the C value is less than 0.82, high strength and yield ratio cannot be obtained. Therefore, the C value is set to 0.82 or more. The C value is preferably 0.83 or more and more preferably 0.85 or more.

In a case where the C value is more than 0.95, a substructure excessively develops in the microstructure, and it becomes difficult to obtain a high yield ratio in order to introduce moving dislocation during cooling. Therefore, the C value is set to 0.95 or less. The C value is preferably 0.90 or less and more preferably 0.88 or less.

The M value represents the uniformity of the entire microstructure and increases as the area of regions having a certain brightness difference increases. A high M value means that the uniformity of the microstructure is high. In the present embodiment, since there is a need to make the microstructure mainly contain highly uniform bainitic ferrite, it is necessary to increase the M value. In a case where the M value is less than 0.0040, bainitic ferrite in which fine cementite or MA (a mixture of fresh martensite and residual austenite) is dispersed in the structure is formed, and excellent bendability and toughness can be obtained. Therefore, the M value is set to 0.0040 or more. The M value is preferably 0.0060 or more and more preferably 0.0080 or more. When the M value is set to 0.0080 or more, the bendability of the hot rolled steel sheet can be further enhanced.

The M value is preferably as high as possible; however, in a microstructure mainly containing bainitic ferrite, it is difficult to control the M value to more than 0.0200, and thus the M value is set to 0.0200 or less. The M value is preferably 0.0150 or less, more preferably 0.0120 or less, 0.0100 or less, or 0.090 or less.

The C value and the M value can be obtained by the following method. The following measurement is performed on regions other than the region determined to be polygonal ferrite in the above-described structure observation. The regions other than the region determined to be polygonal ferrite refers to the remainder in the microstructure and, among crystal grains surrounded by the grain boundaries having an orientation difference of 150 or more, crystal grains where the grain average misorientation (GAM value) within a crystal grain is more than 0.4°.

In the present embodiment, the photographing region of a SEM image that is photographed to calculate the C value and the M value is at the ¼ position of the sheet thickness from the surface of the steel sheet and the center position in the sheet width direction in a cross section parallel to the rolling direction. The SEM image is photographed using an SU-6600 Schottky electron gun manufactured by Hitachi High-Technologies Corporation with a tungsten emitter and an accelerating voltage of 1.5 kV. Based on the above settings, the SEM image is output at a magnification of 3000 times in 256 grayscale levels. The observation area is set to 30 μm×30 μm, and the number of observed visual fields is set to 5 visual fields.

Next, on an image obtained by cutting out the obtained SEM image into a 880×880-pixel region, a smoothing treatment described in Non-Patent Document 3, in which the contrast-enhanced limit magnification is set to 2.0 and the tile grid size is 8×8 is performed. The smoothed SEM image is rotated counterclockwise from 0 degrees to 179 degrees in increments of 1 degree, excluding 90 degrees, and an image is created at each angle, thereby obtaining a total of 179 images. Next, from each of these 179 images, the frequency values of brightness between adjacent pixels are sampled in a matrix form using the gray-level co-occurrence matrix method (GLCM method) described in Non-Patent Document 1.

179 matrixes of the frequency values sampled by the above method are expressed as $p_k$ (k=0 . . . 89, 91, 179) where k is a rotation angle from the original image. $p_k$'s generated for the individual images are summed for all k's (k=0 . . . 89, 91, 179), and then 256×256 matrixes P standardized such that the total of individual components becomes 1 are calculated. Furthermore, the C value and the M value are each calculated using the following formula (1) and formula (2) described in Non-Patent Document 2. The average value obtained by the measurement at all of the visual fields is calculated. The C value is calculated by the following formula (1), but is calculated using the 256×256 matrix P as described above, and thus, in a case where there is a desire to emphasize this point, the formula (1) can be corrected to the following formula (1').

P(i, j) in the following formula (1) and formula (2) is a gray-level co-occurrence matrix, and $\mu_x$, $\mu_y$, $\sigma_x$, and $\sigma_y$ are represented by the following formulas (3) to (6). In the following formulae (1) to (6), the value at the $i^{th}$ row in the $j^{th}$ column of the matrix P is expressed as P(i, j).

In addition, the C value is calculated using the 256×256 matrix P as described above, and thus, in a case where there is a desire to emphasize this point, the formulae (3) to (6) can be corrected to the following formulae (3') to (6'). In the following formula (1') and formulae (3') to (6'), the value at the $i^{th}$ row in the $j^{th}$ column of the matrix P is expressed as $P_{ij}$.

$$\text{Correlation} = \sum_i \sum_j \frac{P(i, j)[(i-\mu_x)\cdot(j-\mu_y)]}{\sigma_x \sigma_y}, \tag{1}$$

$$\text{Maximum Probability} = \text{Max}(P(i, j)) \tag{2}$$

$$\mu_x = \sum_i \sum_j i(P(i, j)) \tag{3}$$

$$\mu_y = \sum_j \sum_j j(P(i, j)) \tag{4}$$

$$\sigma_x = \sum_i \sum_j P(i, j)(i-\mu_x)^2 \tag{5}$$

$$\sigma_y = \sum_i \sum_j P(i, j)(i-\mu_y)^2 \tag{6}$$

$$C = \sum_{i=1,j=1}^{i=256,j=256} P_{ij}\left[\frac{(i-\mu_x)(i-\mu_y)}{\sqrt{(\sigma_x^2)(\sigma_y^2)}}\right] \tag{1'}$$

$$\mu_x = \sum_{j=1,j=1}^{i=256,j=256} i(P_{ij}) \tag{3'}$$

$$\mu_y = \sum_{i=1,j=1}^{i=256,j=256} j(P_{ij}) \tag{4'}$$

$$\sigma_x = \sum_{i=1,j=1}^{i=256,j=256} P_{ij}(i-\mu_x)^2 \tag{5'}$$

$$\sigma_y = \sum_{i=1,j=1}^{i=256 j=256} P_{ij}(i-\mu_y)^2 \tag{6'}$$

Mechanical Properties

In the present embodiment, tensile strength and total elongation are evaluated according to JIS Z 2241:2011. A test piece is a No. 5 test piece of JIS Z 2241: 2011. The sampling position of the tensile test piece may be set to a ¼ portion from the end portion in the sheet width direction, and a direction perpendicular to the rolling direction may be set to the longitudinal direction.

In the hot rolled steel sheet according to the present embodiment, the tensile strength may be 780 MPa or more. The tensile strength is preferably 800 MPa or more. When the tensile strength is set to 780 MPa or more, it is possible to make the hot rolled steel sheet significantly contribute to the weight reduction of vehicle bodies without limiting applicable parts.

In addition, since it is substantially difficult to set the tensile strength of 980 MPa or more in order to achieve both excellent bendability and toughness, the tensile strength may be set to less than 980 MPa or 900 MPa or less.

In the hot rolled steel sheet according to the present embodiment, the total elongation may be 15.0% or more. The total elongation is preferably 18.0% or more.

In the hot rolled steel sheet according to the present embodiment, the yield ratio may be 0.86 or more. The yield ratio is obtained by dividing the yield stress by the tensile strength (yield stress/tensile strength). As the yield stress, a tensile test is performed by the above-described method, and the upper yield point is used in a case where the hot rolled steel sheet yields discontinuously, and the 0.2% proof stress is used in a case where the hot rolled steel sheet yields continuously.

In the hot rolled steel sheet according to the present embodiment, the ratio R/t of the limit bend radius R to the sheet thickness t may be 0.8 or less, where the limit bend radius is obtained by a test according to a V-block method to be described below. When R/t is 0.8 or less, the hot rolled steel sheet can be determined to have excellent bendability. R/t is more preferably 0.5 or less.

The limit bend R/t is obtained by the following method.

A 100 mm×30 mm strip-shaped test piece is cut out from a ½ position in the width direction of the hot-rolled steel sheet. Regarding bending (L-axis bending) in which the bend ridge is parallel to the rolling direction (L direction), a bending test is performed according to "6.3 V block method" (here, the bending angle θ is set to 90°) of JIS Z 2248:2006. The minimum bend radius R at which cracks are not initiated is obtained and divided by the sheet thickness t, thereby obtaining the limit bend R/t.

Here, the presence or absence of cracks is determined by observing cracks on the bent surface of the test piece after the testing with a magnifying glass or an optical microscope at a magnification of 10 times or more and determining that cracks are present in a case where the crack lengths that are observed on the bent surface of the test piece exceeds 0.5 mm.

In the hot rolled steel sheet according to the present embodiment, the absorbed energy at −100° C. may be 120 J/cm$^2$ or more. When the absorbed energy at −100° C. is 120 J/cm$^2$ or more, it is possible to determine that the hot rolled steel sheet has excellent toughness.

The absorbed energy is obtained by the following method.

A Charpy test piece having a V notch is produced from the hot rolled steel sheet. The Charpy test piece is produced such that the longitudinal direction of the test piece becomes parallel to the rolling direction of the hot rolled steel sheet. A charpy impact test is performed at −100° C. using the obtained Charpy test piece according to JIS Z 2242:2018. The absorbed energy obtained by the charpy impact test is divided by the original cross-sectional area of a cutout part (the cross-sectional area of a cutout part of a Charpy impact piece before the charpy impact test), thereby obtaining the absorbed energy (J/cm$^2$) at −100° C.

Sheet Thickness

The sheet thickness of the hot rolled steel sheet according to the present embodiment is not particularly limited and may be set to 0.6 to 8.0 mm. When the sheet thickness of the hot rolled steel sheet is set to 0.6 mm or more, it is possible to suppress the rolling force becoming excessive and to easily perform hot rolling. In addition, when the sheet thickness is set to 8.0 mm or less, the refinement of the microstructure becomes easy, and the above-described microstructure can be easily obtained.

Plating Layer

The hot rolled steel sheet may be made into a surface-treated steel sheet by providing a plating layer on the surface for the purpose of improving corrosion resistance or the like. The plating layer may be an electro plating layer or a hot-dip plating layer. Examples of the electro plating layer include electrogalvanizing, electro Zn—Ni alloy plating, and the like. Examples of the hot-dip plating layer include hot-dip galvanizing, hot-dip galvannealing, hot-dip aluminum plating, hot-dip Zn—Al alloy plating, hot-dip Zn—Al—Mg alloy plating, hot-dip Zn—Al—Mg—Si alloy plating, and the like. The plating adhesion amount is not particularly limited and may be the same as before. In addition, it is also possible to further enhance the corrosion resistance by performing an appropriate chemical conversion treatment (for example, the application and drying of a silicate-based chromium-free chemical conversion treatment liquid) after plating.

Manufacturing Conditions

A suitable manufacturing method of the hot-rolled steel sheet according to the present embodiment is as described below.

In order to obtain the hot rolled steel sheet according to the present embodiment, it is effective to perform hot rolling under predetermined conditions and control the cooling history through the subsequent coiling.

In the suitable manufacturing method of the hot rolled steel sheet according to the present embodiment, the following steps (1) to (8) are sequentially performed. The temperature of a slab and the temperature of a steel sheet in the present embodiment refer to the surface temperature of the slab and the surface temperature of the steel sheet.

(1) The slab is held in a temperature range of 1200° C. or higher for 1.0 hour or longer.

(2) Rolling is performed twice or more with a rolling reduction of 30% or larger, and rough rolling is completed in a temperature range of 1100° C. or higher.

(3) The finish rolling start temperature is set to T1 (° C.) or higher that is obtained by the following formula (A), and the finish rolling finishing temperature is set to T1—100° C. or higher and T1—20° C. or lower.

(4) The rolled steel sheet is cooled to a temperature range of 640° C. to 730° C. at an average cooling rate of 80° C./s or faster (primary cooling).

(5) Air cooling is started in a temperature range of 640° C. to 730° C., and the air cooling time is set to 2.6 to 8.1 seconds (intermediate air cooling).

(6) The rolled steel sheet is cooled to a temperature range of 500° C. to 600° C. at an average cooling rate of 18 to 28° C./s (secondary cooling).

(7) The rolled steel sheet is cooled to a temperature range of 100° C. or lower at an average cooling rate of 65 to 100° C./s (tertiary cooling).

(8) The rolled steel sheet is coiled in a temperature range of 100° C. or lower.

$$T1(^\circ C.)=907+168\times Ti+1325\times Nb+1200\times Mo+4500\times B \quad (A)$$

An element symbol in the above formula indicates the content of each element by mass %. In a case where the element is not contained, a value of 0% is substituted.

Adopting the above manufacturing method makes it possible to stably manufacture a hot rolled steel sheet having high strength and yield ratio and excellent bendability, toughness, and external appearance. That is, the slab heating conditions, the hot rolling conditions, and the cooling conditions after hot rolling are combined, which makes it possible to stably manufacture a hot rolled steel sheet having a desired microstructure.

Slab, Slab Temperature when Subjected to Hot Rolling, and Holding Time

A manufacturing step preceding hot rolling is not particularly limited. That is, subsequent to melting with a blast furnace, an electric furnace, or the like, a variety of secondary smelting is performed, and then casting may be performed by a method such as ordinary continuous casting, casting by an ingot method, or thin slab casting. In a case of continuous casting, a cast slab may be cooled to a low temperature, then, heated again and then hot-rolled or a cast slab may be hot-rolled as it is after casting without being cooled to a low temperature. Scrap may be used as a raw material. In addition, scrap to which hot working or cold working has been performed can also be used as necessary. The slab that is subjected to hot rolling is preferably held in a temperature range of 1200° C. or higher for 1.0 hour or longer (3600 seconds or longer). While the slab is held in the temperature range of 1200° C. or higher, the steel sheet temperature may be fluctuated or be maintained constant in the temperature range of 1200° C. or higher. When the slab is held in the temperature range of 1200° C. or higher for 1.0 hour or longer, it is possible to sufficiently solutionize the slab, and, as a result, a desired tensile strength can be obtained.

Rough Rolling

Hot rolling is roughly classified into rough rolling and finish rolling. In the rough rolling, it is preferable to perform rolling twice or more with a rolling reduction of 30% or larger and complete the rough rolling in a temperature range of 1100° C. or higher. When rolling is performed twice or more with a rolling reduction of 30% or larger, it is possible to enhance the uniformity of the microstructure, and, as a result, the M value can be increased. In addition, in a case where the temperature at which the rough rolling is completed (the temperature at the delivery side of the final pass of the rough rolling) is set to lower than 1100° C., since the austenite grain diameters becomes non-uniform before the start of the finish rolling, and the microstructure during the finish rolling becomes non-uniform, the M value decreases. Therefore, the rough rolling finishing temperature is set to 1100° C. or higher.

The rolling reduction can be represented by $\{(t_0-t_1)/t_0\}\times 100$ where the inlet sheet thickness before rolling in each pass of the rough rolling step is represented by to and the outlet sheet thickness after rolling is represented by $t_1$.

Finish Rolling

Finish rolling is performed after the rough rolling. In the finish rolling, it is preferable to set the finish rolling start temperature (the entry side temperature of the first pass of the finish rolling) to T1 (° C.) that is obtained by the formula (A) or higher and set the finish rolling finishing temperature (the delivery side temperature of the final pass of the finish rolling) to T1—100° C. or higher and T1—20° C. or lower. When the finish rolling start temperature is set to T1 (° C.) or higher and the finish rolling finishing temperature is set to T1—100° C. or higher, it is possible to suppress the excessive precipitation of polygonal ferrite. In addition, when the finish rolling finishing temperature is set to T1—20° C. or lower, it is possible to enhance the uniformity of the entire microstructure, and, as a result, the M value can be increased.

In the finish rolling, it is more preferable to set the cumulative rolling reduction in a temperature range of T1 (° C.) or higher to 80.0% or more and to set the cumulative rolling reduction in a temperature range of lower than T1 (° C.) to 50.0% or less. This makes it possible to further enhance the uniformity of the entire microstructure, and, as a result, makes it possible to further increase the M value.

The cumulative rolling reduction in the temperature range of T1 (° C.) or higher can be represented by $\{(t_2-t_3)/t_2\}\times 100(\%)$ where the inlet sheet thickness of the first pass of the finish rolling is represented by $t_2$, and the sheet thickness when the steel sheet temperature is T1 (° C.) is represented by $t_3$. In addition, the cumulative rolling reduction in the temperature range of lower than T1 (° C.) can be represented by $\{(t_3-t_4)/t_3\}\times 100(\%)$ where the sheet thickness when the steel sheet temperature is T1 (° C.) is represented by $t_3$, and the exit-side thickness of the final pass of the finish rolling is represented by $t_4$.

Primary Cooling

After the finish rolling, it is preferable to cool the rolled steel sheet to a temperature range of 640° C. to 730° C. at an average cooling rate of 80° C./s or faster. In a case where the average cooling rate is slower than 80° C./s, polygonal ferrite may be excessively precipitated.

The average cooling rate to the temperature range of 640° C. to 730° C. may be set to slower than 400° C./s from the viewpoint of stably manufacturing the hot rolled steel sheet.

In the present embodiment, the average cooling rate refers to a value obtained by dividing the temperature drop width of the steel sheet from the start of the cooling to the finishing of the cooling by the time necessary from the start of the cooling to the finishing of the cooling.

Intermediate Air Cooling

After the cooling to the temperature range of 640° C. to 730° C. at the average cooling rate of 80° C./s or faster, it is preferable to perform air cooling in a temperature range of 640° C. to 730° C. for 2.6 to 8.1 seconds. In addition, the temperature at which the air cooling is ended is preferably 600° C. or higher. When the temperature at which the air cooling is performed is lower than 640° C. or the temperature at which the air cooling is ended is lower than 600° C., a desired M value cannot be obtained. When the air cooling time is set to 2.6 seconds or longer, it is possible to uniformly form the product nuclei of bainitic ferrite, the uniformity of the microstructure can be enhanced, and, as a result, the M value can be increased. In addition, when the air cooling time is set to 8.1 seconds or shorter, the excessive precipitation of polygonal ferrite can be suppressed.

The average cooling rate during the air cooling is set to slower than 10° C./s. In addition, in a case where the rolled steel sheet is cooled to a coiling temperature without performing the intermediate air cooling, the precipitation nuclei of bainitic ferrite are not sufficiently formed, and a substructure develops in the structure, and thus it becomes difficult to control the C value to 0.95 or less.

Secondary Cooling

After the air cooling, it is preferable to perform cooling to a temperature range of 500° C. to 600° C. at an average cooling rate of 18 to 28° C./s. When the average cooling rate to the temperature range of 500° C. to 600° C. is set to 18°

C./s or faster, it is possible to appropriately control the substructure in the bainitic ferrite, and, as a result, the C value can be increased. In addition, when the average cooling rate to the temperature range of 500° C. to 600° C. is set to 28° C./s or slower, it is possible to enhance the uniformity of the entire microstructure, and, as a result, the M value can be increased.

Tertiary Cooling

After the cooling to the temperature range of 500° C. to 600° C. at the average cooling rate of 15° C./s or faster and slower than 30° C./s, it is preferable to perform cooling to a temperature range of 100° C. or lower at an average cooling rate of 65 to 100° C./s. When the average cooling rate to the temperature range of 100° C. or lower is set to 65 to 100° C./s, it is possible to enhance the uniformity of the entire microstructure, and, as a result, the M value can be increased.

Coiling

The coiling temperature is preferably set to 100° C. or lower. When the coiling temperature is set to 100° C. or lower, it is possible to enhance the uniformity of the entire microstructure, and, as a result, the M value can be increased.

EXAMPLES

Next, the effect of one aspect of the present invention will be more specifically described using examples, but conditions in the examples are simply examples of the conditions adopted to confirm the feasibility and effect of the present invention, and the present invention is not limited to these examples of the conditions. The present invention is capable of adopting a variety of conditions as long as the object of the present invention is achieved without departing from the gist of the present invention.

Steels having a chemical composition shown in Tables 1 and 2 were melted and continuously cast to manufacture slabs having a thickness of 240 to 300 mm. Hot rolled steel sheets shown in Tables 11 to 14 were obtained using the obtained slabs under manufacturing conditions shown in Tables 3 to 10. The average cooling rates during intermediate air cooling were set to slower than 10° C./s. Secondary cooling was performed to a temperature range of 500° C. to 600° C., and tertiary cooling was performed to coiling temperatures shown in the tables.

In finish rolling, a total of seven stages of finish rolling was performed on the steel sheets rolled to sheet thicknesses at the start of the finish rolling by rough rolling. The rolling reduction from the first to the third stages among the seven stages was regarded as the cumulative rolling reduction (%) until F1, the first stage rolling was started at a finish rolling start temperature, and each pass of rolling was performed such that the temperature after the third stage rolling became a temperature before F1 biting. After that, the fourth stage rolling was represented by F1, the fifth stage rolling was represented by F2, the sixth stage rolling represented by F3, the seventh stage rolling was represented by F4, and the finish rolling was performed such that the rolling reductions of F1 to F4 shown in the tables and the temperatures shown as the F1 to F4 delivery side temperatures were reached.

For the obtained hot rolled steel sheets, the area ratios of polygonal ferrite, the C values, the M values, the tensile strengths, the yield ratios, the total elongation, the limit bend radii, and the impact absorbed energies at −100° C. were obtained by the above-described methods. The obtained measurement results are shown in Tables 11 to 14. For examples in which the area ratio of polygonal ferrite was 10.0% or more, the C value and the M value were not measured.

Acceptance Criteria for Properties of Hot Rolled Steel Sheets

Strength

In a case where the tensile strength TS was 780 MPa or more, a hot rolled steel sheet was determined to be acceptable for having a high strength. On the other hand, in a case where the tensile strength TS was less than 780 MPa, a hot rolled steel sheet was determined to be unacceptable for not having a high strength.

Total Elongation

In a case where the total elongation EL was 15.0% or more, a hot rolled steel sheet was determined to be acceptable for having excellent ductility. On the other hand, in a case where the total elongation EL was less than 15.0%, a hot rolled steel sheet was determined to be unacceptable for not having excellent ductility.

Yield Ratio

In a case where the yield ratio was 0.86 or more, a hot rolled steel sheet was determined to be acceptable for having a high yield ratio. On the other hand, in a case where the yield ratio was less than 0.86, a hot rolled steel sheet was determined to be unacceptable for not having a high yield ratio.

Bendability

In a case where the limit bend R/t was 0.8 or less, a hot rolled steel sheet was determined to be acceptable for having excellent bendability. In a case where the limit bend R/t was more than 0.8, a hot rolled steel sheet was determined to be unacceptable for not having excellent bendability. In addition, in a case where the limit bend R/t was 0.5 or less, a hot rolled steel sheet was determined to have superior bendability.

Toughness

In a case where the absorbed energy at −100° C. $vE_{-100}$ was 120 J/cm$^2$ or higher, a hot rolled steel sheet was determined to be acceptable for having excellent toughness. On the other hand, in a case where the absorbed energy at −100° C. $vE_{-100}$ was lower than 120 J/cm$^2$, a hot rolled steel sheet was determined to be unacceptable for not having excellent toughness.

External Appearance

Regarding the external appearance, when a region with an arithmetic average roughness Ra, which is measured according to JIS B 0601:2013, of 1.5 μm or more was defined as a scale pattern portion, in a case where the area ratio of scale pattern portions on both surfaces of a 1000 mm×1000 mm sample sampled from the hot rolled steel sheet was 10% or less, a hot rolled steel sheet was determined to be acceptable for having excellent external appearance, and "OK" was entered in the tables. On the other hand, in a case where the area ratio of the scale pattern portions was more than 10%, a hot rolled steel sheet was determined to be unacceptable for having poor external appearance, and "NG" was entered in the tables.

The arithmetic average roughness Ra was obtained by, specifically, the following method. On the surface of the 1000 mm×1000 mm sample, sites at 200 mm intervals in the rolling direction and the sheet width direction were regarded as measurement sites, and the roughness of the surface was measured at each measurement site. Here, the measurement length at each measurement site was set to 5 mm. A roughness curves were obtained by sequentially applying a contour curve filter with cut-off values of λc and λs to a cross-sectional curve obtained by the measurement. Specifically, a roughness curve was obtained by removing a component with a wavelength λc of 0.8 mm or shorter and a component with a wavelength λs of 2.5 mm or longer from the obtained measurement results. Based on the obtained roughness curve, the arithmetic average roughness Ra of each measurement site was calculated according to JIS B 0601:2013. The ratio of the number of measurement sites where Ra was 15 μm or more to the number of all of the measurement sites (=the number of measurement sites where Ra was 15 μm or more/the number of all of the measurement sites) was regarded as the area ratio of the scale pattern portions.

TABLE 1

| Kind of steel | Chemical composition (unit: mass %, remainder: Fe and impurity) | | | | | | | | | | | | | |
|---|---|---|---|---|---|---|---|---|---|---|---|---|---|---|
| | C | Mn | sol.Al | T − Al | Ti | Si | P | S | N | O | Others | Si + [T − Al] | T1 (° C.) | Note |
| A | 0.053 | 1.20 | 0.351 | 0.353 | 0.135 | 0.061 | 0.010 | 0.001 | 0.002 | 0.001 | | 0.414 | 930 | Present Invention Steel |
| B | 0.028 | 1.82 | 0.471 | 0.474 | 0.102 | 0.070 | 0.034 | 0.001 | 0.002 | 0.010 | | 0.544 | 924 | Present Invention Steel |
| C | 0.041 | 1.91 | 0.282 | 0.283 | 0.121 | 0.055 | 0.014 | 0.001 | 0.002 | 0.001 | | 0.338 | 927 | Present Invention Steel |
| D | 0.051 | 1.05 | 0.331 | 0.333 | 0.162 | 0.045 | 0.012 | 0.001 | 0.002 | 0.001 | | 0.378 | 934 | Present Invention Steel |
| E | 0.044 | 1.21 | 0.211 | 0.218 | 0.120 | 0.084 | 0.011 | 0.001 | 0.002 | 0.001 | | 0.302 | 927 | Present Invention Steel |
| F | 0.040 | 1.44 | 0.315 | 0.319 | 0.141 | 0.032 | 0.012 | 0.001 | 0.002 | 0.001 | | 0.351 | 931 | Present Invention Steel |
| G | 0.105 | 1.82 | 0.410 | 0.417 | 0.185 | 0.063 | 0.011 | 0.001 | 0.002 | 0.002 | | 0.480 | 938 | Comparative Steel |
| H | 0.020 | 1.55 | 0.281 | 0.283 | 0.089 | 0.044 | 0.010 | 0.001 | 0.002 | 0.001 | | 0.327 | 922 | Comparative Steel |
| I | 0.050 | 1.28 | 0.244 | 0.251 | 0.154 | 0.530 | 0.012 | 0.001 | 0.002 | 0.001 | | 0.781 | 933 | Comparative Steel |
| J | 0.042 | 0.84 | 0.255 | 0.258 | 0.121 | 0.018 | 0.011 | 0.001 | 0.002 | 0.001 | | 0.276 | 927 | Comparative Steel |
| K | 0.047 | 2.40 | 0.314 | 0.317 | 0.144 | 0.015 | 0.010 | 0.001 | 0.003 | 0.002 | | 0.332 | 931 | Comparative Steel |
| L | 0.039 | 1.63 | 0.095 | 0.097 | 0.163 | 0.024 | 0.011 | 0.001 | 0.002 | 0.001 | | 0.121 | 934 | Comparative Steel |
| M | 0.042 | 1.80 | 0.610 | 0.611 | 10.122 | 0.035 | 0.010 | 0.001 | 0.002 | 0.001 | | 0.646 | 927 | Comparative Steel |
| AH | 0.050 | 1.12 | 0.467 | 0.469 | 0.255 | 0.008 | 0.010 | 0.001 | 0.002 | 0.001 | | 0.477 | 950 | Comparative Steel |
| N | 0.035 | 1.81 | 0.031 | 0.032 | 0.010 | 0.055 | 0.010 | 0.001 | 0.003 | 0.001 | | 0.087 | 909 | Comparative Steel |
| O | 0.043 | 1.61 | 0.300 | 0.306 | 0.128 | 0.051 | 0.012 | 0.001 | 0.003 | 0.001 | Nb: 0.019 | 0.357 | 954 | Present Invention Steel |
| P | 0.041 | 1.77 | 0.321 | 0.328 | 0.105 | 0.066 | 0.012 | 0.001 | 0.002 | 0.001 | W: 0.042 | 0.394 | 925 | Present Invention Steel |

Underlines indicate that corresponding values are outside the scope of the present invention.

TABLE 2

| Kind of steel | Chemical composition (unit: mass %, remainder: Fe and impurity) | | | | | | | | | | | | | |
|---|---|---|---|---|---|---|---|---|---|---|---|---|---|---|
| | C | Mn | sol.Al | T − Al | Ti | Si | P | S | N | O | Others | Si + [T − Al] | T1 (° C.) | Note |
| Q | 0.038 | 1.37 | 0.258 | 0.264 | 0.109 | 0.045 | 0.011 | 0.001 | 0.002 | 0.001 | V: 0.030 | 0.309 | 925 | Present Invention Steel |

TABLE 2-continued

| Kind of steel | Chemical composition (unit: mass %, remainder: Fe and impurity) C | Mn | sol.Al | T − Al | Ti | Si | P | S | N | O | Others | Si + [T − Al] | T1 (° C.) | Note |
|---|---|---|---|---|---|---|---|---|---|---|---|---|---|---|
| R | 0.042 | 1.54 | 0.321 | 0.327 | 0.132 | 0.071 | 0.010 | 0.001 | 0.002 | 0.001 | B: 0.0012 | 0.398 | 934 | Present Invention Steel |
| S | 0.033 | 1.42 | 0.289 | 0.291 | 0.121 | 0.061 | 0.011 | 0.001 | 0.002 | 0.001 | Mo: 0.015 | 0.352 | 945 | Present Invention Steel |
| T | 0.047 | 1.63 | 0.410 | 0.411 | 0.098 | 0.020 | 0.011 | 0.001 | 0.002 | 0.001 | Cu: 0.05 | 0.431 | 923 | Present Invention Steel |
| U | 0.053 | 1.23 | 0.301 | 0.305 | 0.123 | 0.089 | 0.011 | 0.001 | 0.002 | 0.001 | Ni: 0.51 | 0.394 | 928 | Present Invention Steel |
| V | 0.044 | 1.46 | 0.257 | 0.260 | 0.113 | 0.054 | 0.011 | 0.001 | 0.003 | 0.001 | Cr: 0.53 | 0.314 | 926 | Present Invention Steel |
| W | 0.042 | 1.11 | 0.418 | 0.421 | 0.120 | 0.033 | 0.010 | 0.001 | 0.003 | 0.001 | Co: 0.462 | 0.454 | 927 | Present Invention Steel |
| X | 0.036 | 1.65 | 0.325 | 0.331 | 0.144 | 0.081 | 0.010 | 0.001 | 0.003 | 0.001 | Ca: 0.0151 | 0.412 | 931 | Present Invention Steel |
| Y | 0.050 | 1.34 | 0.254 | 0.256 | 0.099 | 0.042 | 0.012 | 0.001 | 0.002 | 0.001 | Mg: 0.0103 | 0.298 | 924 | Present Invention Steel |
| Z | 0.039 | 1.38 | 0.289 | 0.292 | 0.119 | 0.022 | 0.011 | 0.001 | 0.003 | 0.001 | REM: 0.0082 | 0.314 | 927 | Present Invention Steel |
| AA | 0.045 | 1.49 | 0.351 | 0.355 | 0.121 | 0.051 | 0.011 | 0.001 | 0.003 | 0.001 | Zr: 0.004 | 0.406 | 927 | Present Invention Steel |
| AB | 0.054 | 1.74 | 0.254 | 0.256 | 0.132 | 0.088 | 0.011 | 0.001 | 0.003 | 0.001 | Nb: 0.038 | 0.344 | 980 | Present Invention Steel |
| AC | 0.044 | 1.42 | 0.451 | 0.454 | 0.140 | 0.084 | 0.010 | 0.001 | 0.003 | 0.001 | Nb: 0.010 | 0.538 | 944 | Present Invention Steel |
| AD | 0.051 | 1.38 | 0.301 | 0.305 | 0.128 | 0.055 | 0.011 | 0.001 | 0.002 | 0.001 | Nb: 0.013, V: 0.020 | 0.360 | 946 | Present Invention Steel |
| AE | 0.049 | 1.45 | 0.315 | 0.322 | 0.131 | 0.051 | 0.010 | 0.001 | 0.002 | 0.001 | Zn: 0.052 | 0.373 | 929 | Present Invention Steel |
| AF | 0.040 | 1.44 | 0.298 | 0.303 | 0.121 | 0.032 | 0.011 | 0.001 | 0.003 | 0.001 | Bi: 0.0112 | 0.335 | 927 | Present Invention Steel |
| AG | 0.035 | 1.58 | 0.301 | 0.304 | 0.101 | 0.064 | 0.012 | 0.001 | 0.003 | 0.001 | Sn: 0.020 | 0.368 | 924 | Present Invention Steel |
| AI | 0.041 | 1.3 | 0.282 | 0.284 | 0.035 | 0.053 | 0.011 | 0.001 | 0.003 | 0.001 | | 0.337 | 913 | Present Invention Steel |
| AJ | 0.030 | 1.5 | 0.321 | 0.324 | 0.198 | 0.062 | 0.012 | 0.001 | 0.003 | 0.001 | | 0.386 | 940 | Present Invention Steel |

TABLE 3

| | | Slab heating | | Rough rolling | | Finish rolling | | | | | | | | |
|---|---|---|---|---|---|---|---|---|---|---|---|---|---|---|
| Manufacturing No. | Kind of steel | Heating temperature (° C.) | Holding time (h) | Finishing temperature (° C.) | Number of times of rolling with rolling reduction of 30% or larger (times) | Cumulative rolling reduction until F1 (%) | Rolling reduction of F1 (%) | Rolling reduction of F2 (%) | Rolling reduction of F3 (%) | Rolling reduction of F4 (%) | Cumulative rolling reduction at higher T1° C. or (%) | Cumulative rolling reduction at lower T1° C. or (%) | Sheet thickness at start of finish rolling (mm) | Sheet thickness at end of finish rolling (mm) |
| 1 | A | 1245 | 2.2 | 1152 | 3 | 73.7 | 32.6 | 16.1 | 25.0 | 25.6 | 82.3 | 53.2 | 35.0 | 2.9 |
| 2 | A | 1230 | 2.4 | 1134 | 4 | 81.4 | 10.8 | 13.8 | 16.1 | 13.3 | 83.4 | 37.3 | 35.0 | 3.6 |
| 3 | A | 1260 | 2.5 | 1139 | 4 | 73.4 | 19.4 | 18.7 | 24.6 | 21.0 | 78.6 | 51.5 | 35.0 | 3.6 |
| 4 | A | 1255 | 2.3 | 1143 | 3 | 74.3 | 16.7 | 20.0 | 23.3 | 21.0 | 78.6 | 51.5 | 35.0 | 3.6 |
| 5 | B | 1253 | 2.5 | 1130 | 3 | 69.3 | 18.5 | 20.0 | 33.3 | 27.5 | 80.0 | 51.7 | 30.0 | 2.9 |
| 6 | B | 1237 | 1.9 | 1145 | 3 | 81.4 | 10.8 | 13.8 | 16.1 | 13.3 | 83.4 | 37.3 | 35.0 | 3.6 |
| 7 | B | 1250 | 1.5 | 1078 | 2 | 71.4 | 25.0 | 13.3 | 38.5 | 27.5 | 81.4 | 55.4 | 35.0 | 2.9 |
| 8 | B | 1255 | 2.5 | 1149 | 3 | 74.3 | 15.6 | 19.7 | 24.6 | 21.0 | 78.3 | 52.2 | 35.0 | 3.6 |
| 9 | C | 1235 | 2.3 | 1165 | 4 | 74.3 | 17.8 | 18.9 | 23.3 | 21.0 | 78.9 | 50.9 | 35.0 | 3.6 |
| 10 | C | 1230 | 2.1 | 1144 | 3 | 80.3 | 15.9 | 13.8 | 18.0 | 11.3 | 83.4 | 37.3 | 35.0 | 3.6 |
| 11 | C | 1250 | 2.5 | 1149 | 3 | 74.6 | 28.0 | 18.8 | 19.4 | 13.3 | 74.6 | 59.2 | 35.0 | 3.6 |
| 12 | C | 1240 | 2.2 | 1145 | 3 | 61.7 | 30.4 | 21.3 | 27.0 | 21.0 | 79.0 | 42.3 | 30.0 | 3.6 |
| 13 | D | 1225 | 2.5 | 1125 | 4 | 74.3 | 16.7 | 21.3 | 22.0 | 21.0 | 78.6 | 51.5 | 35.0 | 3.6 |
| 14 | D | 1244 | 2.4 | 1145 | 3 | 73.7 | 32.6 | 16.1 | 25.0 | 25.6 | 82.3 | 53.2 | 35.0 | 2.9 |
| 15 | E | 1235 | 2.0 | 1153 | 4 | 69.3 | 18.5 | 17.3 | 35.5 | 27.5 | 79.3 | 53.2 | 30.0 | 2.9 |
| 16 | E | 1250 | 2.6 | 1135 | 1 | 74.3 | 16.7 | 21.3 | 22.0 | 21.0 | 78.6 | 51.5 | 35.0 | 3.6 |
| 17 | F | 1246 | 2.5 | 1131 | 3 | 61.7 | 30.4 | 22.5 | 27.4 | 19.2 | 79.3 | 41.4 | 30.0 | 3.6 |
| 18 | F | 1256 | 2.2 | 1132 | 3 | 74.6 | 28.0 | 18.8 | 19.4 | 13.3 | 75.0 | 59.2 | 35.0 | 3.6 |
| 19 | F | 1248 | 2.6 | 1151 | 2 | 73.4 | 33.3 | 14.5 | 28.3 | 23.7 | 82.3 | 53.2 | 35.0 | 2.9 |
| 20 | G | 1225 | 2.0 | 1125 | 3 | 74.3 | 15.6 | 21.1 | 23.3 | 21.0 | 78.3 | 52.2 | 35.0 | 3.6 |

Underlines indicate that corresponding values are outside the scope of the present invention.

TABLE 4

| | | Finish rolling | | | | | | | Cooling after finish rolling | | | | | | | |
|---|---|---|---|---|---|---|---|---|---|---|---|---|---|---|---|---|
| Manufacturing No. | Kind of steel | T1 (° C.) | Finish rolling start temperature (° C.) | Temperature before F1 biting (° C.) | F1 delivery side temperature (° C.) | F2 delivery side temperature (° C.) | F3 delivery side temperature (° C.) | F4 delivery side (finish rolling completion) temperature (° C.) | Primary cooling Average cooling rate (° C./s) | Intermediate air cooling Start temperature (° C.) | Intermediate air cooling End temperature (° C.) | Intermediate air cooling Air cooling time (s) | Secondary cooling Average cooling rate (° C./s) | Tertiary cooling Average cooling rate (° C./s) | Coiling Coiling temperature (° C.) | Note |
| 1 | A | 930 | 1053 | 944 | 926 | 916 | 896 | 885 | 110 | 705 | 692 | 4.2 | 20 | 80 | 60 | Present Invention Example |
| 2 | A | 930 | 1048 | 939 | 926 | 910 | 903 | 891 | 90 | 684 | 655 | 5.8 | 27 | 86 | 80 | Present Invention Example |
| 3 | A | 930 | 1035 | 941 | 926 | 919 | 910 | 896 | 90 | 697 | 692 | 1.1 | 25 | 80 | 80 | Comparative Example |
| 4 | A | 930 | 1045 | 942 | 931 | 919 | 903 | 893 | 85 | 705 | 683 | 7.3 | 25 | 80 | 280 | Comparative Example |
| 5 | B | 924 | 1019 | 938 | 925 | 908 | 901 | 890 | 95 | 685 | 671 | 3.5 | 25 | 80 | 80 | Present Invention Example |

TABLE 4-continued

| | | Finish rolling | | | | | | | Cooling after finish rolling | | | | | | | |
|---|---|---|---|---|---|---|---|---|---|---|---|---|---|---|---|---|
| Manufacturing No. | Kind of steel | T1 (° C.) | Finish rolling start temperature (° C.) | Temperature before F1 biting (° C.) | F1 delivery side temperature (° C.) | F2 delivery side temperature (° C.) | F3 delivery side temperature (° C.) | F4 delivery side (finish rolling completion) temperature (° C.) | Primary cooling Average cooling rate (° C./s) | Intermediate air cooling Start temperature (° C.) | Intermediate air cooling End temperature (° C.) | Intermediate air cooling Air cooling time (s) | Secondary cooling Average cooling rate (° C./s) | Tertiary cooling Average cooling rate (° C./s) | Coiling Coiling temperature (° C.) | Note |
| 6 | B | 924 | 1046 | 936 | 921 | 909 | 904 | 899 | 85 | 675 | 661 | 4.6 | 26 | 90 | 40 | Present Invention Example |
| 7 | B | 924 | 1015 | 935 | 922 | 905 | 901 | 995 | 95 | 684 | 669 | 7.3 | 25 | 75 | 80 | Comparative Example |
| 8 | B | 924 | 1044 | 936 | 921 | 911 | 903 | 894 | 90 | 705 | 681 | 12 | 20 | 90 | 60 | Comparative Example |
| 9 | C | 927 | 1033 | 936 | 925 | 915 | 900 | 890 | 90 | 689 | 673 | 8.1 | 18 | 77 | 80 | Present Invention Example |
| 10 | C | 927 | 1053 | 940 | 922 | 915 | 900 | 893 | 90 | 684 | 647 | 7.5 | 18 | 85 | 80 | Present Invention Example |
| 11 | C | 927 | 1085 | 975 | 960 | 951 | 935 | 922 | 90 | 690 | 671 | 6.3 | 20 | 80 | 80 | Comparative Example |
| 12 | C | 927 | 1054 | 945 | 932 | 920 | 909 | 899 | 90 | N/A | N/A | N/A | 25 | 80 | 40 | Comparative Example |
| 13 | D | 934 | 1030 | 941 | 930 | 921 | 907 | 896 | 100 | 675 | 665 | 5.1 | 20 | 90 | 80 | Present Invention Example |
| 14 | D | 934 | 1055 | 940 | 929 | 916 | 908 | 893 | 90 | 666 | 650 | 5.4 | 12 | 80 | 60 | Comparative Example |
| 15 | E | 927 | 1033 | 940 | 931 | 918 | 911 | 904 | 90 | 710 | 689 | 4.2 | 24 | 88 | 80 | Present Invention Example |
| 16 | E | 927 | 1028 | 938 | 924 | 916 | 904 | 892 | 90 | 675 | 655 | 6.6 | 20 | 80 | 80 | Comparative Example |
| 17 | F | 931 | 1056 | 951 | 940 | 929 | 919 | 908 | 90 | 700 | 687 | 3.2 | 21 | 85 | 80 | Present Invention Example |
| 18 | F | 931 | 1009 | 908 | 876 | 851 | 824 | 813 | 100 | 705 | 694 | 5.5 | 21 | 80 | 80 | Comparative Example |
| 19 | F | 931 | 1045 | 935 | 925 | 911 | 905 | 899 | 90 | 685 | 654 | 6.3 | 40 | 80 | 80 | Comparative Example |

TABLE 4-continued

| | | Finish rolling | | | | | | | Cooling after finish rolling | | | | | | Coil- | |
|---|---|---|---|---|---|---|---|---|---|---|---|---|---|---|---|---|
| | | | Finish rolling start temperature | Temperature before F1 biting | F1 delivery side temperature | F2 delivery side temperature | F3 delivery side temperature | F4 delivery side (finish rolling completion) temperature | Primary cooling Average cooling rate | Intermediate air cooling Start temperature | Intermediate air cooling End temperature | Intermediate air cooling Air cooling time | Secondary cooling Average cooling rate | Tertiary cooling Average cooling rate | Coiling Coiling temperature | |
| Manufacturing No. | Kind of steel | T1 (° C.) | (° C.) | (° C.) | (° C.) | (° C.) | (° C.) | (° C.) | (° C./s) | (° C.) | (° C.) | (s) | (° C./s) | (° C./s) | (° C.) | Note |
| 20 | G | 938 | 1046 | 945 | 931 | 920 | 918 | 906 | 80 | 665 | 648 | 3.5 | 20 | 75 | 40 | Comparative Example |

Underlines indicate that corresponding values are outside the scope of the present invention.

TABLE 5

| | | Slab heating | | Rough rolling | | Finish rolling | | | | | | | | |
|---|---|---|---|---|---|---|---|---|---|---|---|---|---|---|
| Manufacturing No. | Kind of steel | Heating temperature (° C.) | Holding time (h) | Finishing temperature (° C.) | Number of times of rolling with rolling reduction of 30% or larger (times) | Cumulative rolling reduction until F1 (%) | Rolling reduction of F1 (%) | Rolling reduction of F2 (%) | Rolling reduction of F3 (%) | Rolling reduction of F4 (%) | Cumulative rolling reduction at higher T1° C. or (%) | Cumulative rolling reduction at lower T1° C. or (%) | Sheet thickness at start of finish rolling (mm) | Sheet thickness at end of finish rolling (mm) |
| 21 | H | 1245 | 2.2 | 1132 | 4 | 69.3 | 18.5 | 17.3 | 35.5 | 27.5 | 79.3 | 53.2 | 30.0 | 2.9 |
| 22 | I | 1256 | 2.5 | 1125 | 4 | 74.3 | 16.7 | 20.0 | 25.0 | 19.2 | 78.6 | 51.5 | 35.0 | 3.6 |
| 23 | J | 1259 | 2.2 | 1145 | 3 | 73.7 | 32.6 | 16.1 | 25.0 | 25.6 | 82.3 | 53.2 | 35.0 | 2.9 |
| 24 | K | 1250 | 2.5 | 1135 | 3 | 70.0 | 30.0 | 17.5 | 25.0 | 25.6 | 79.0 | 54.0 | 30.0 | 2.9 |
| 25 | L | 1270 | 2.6 | 1145 | 4 | 74.3 | 16.7 | 20.0 | 23.3 | 21.0 | 78.6 | 51.5 | 35.0 | 3.6 |
| 26 | M | 1256 | 2.1 | 1140 | 1 | 66.7 | 28.0 | 23.6 | 27.3 | 35.0 | 81.7 | 52.7 | 30.0 | 2.6 |
| 27 | N | 1230 | 2.5 | 1135 | 1 | 74.3 | 16.7 | 20.0 | 25.0 | 19.2 | 78.6 | 51.5 | 35.0 | 3.6 |
| 28 | O | 1250 | 2.0 | 1129 | 4 | 74.3 | 16.7 | 20.0 | 23.3 | 21.0 | 78.6 | 51.5 | 35.0 | 3.6 |
| 29 | O | 1248 | 2.4 | 1115 | 4 | 77.1 | 28.8 | 21.1 | 22.2 | 17.1 | 87.1 | 35.6 | 35.0 | 2.9 |
| 30 | O | 1225 | 2.0 | 1120 | 2 | 74.3 | 16.7 | 20.0 | 23.3 | 21.0 | 78.6 | 51.5 | 35.0 | 3.6 |
| 31 | O | 1235 | 2.1 | 1131 | 3 | 73.4 | 20.4 | 18.9 | 23.3 | 21.0 | 78.9 | 50.9 | 35.0 | 3.6 |
| 32 | O | 1250 | 1.8 | 1135 | 3 | 73.7 | 18.5 | 20.0 | 25.0 | 19.2 | 78.6 | 51.5 | 35.0 | 3.6 |
| 33 | O | 1234 | 2.5 | 1129 | 4 | 73.4 | 19.4 | 20.0 | 25.0 | 19.2 | 78.6 | 51.5 | 35.0 | 3.6 |
| 34 | P | 1235 | 2.3 | 1145 | 4 | 68.8 | 22.0 | 15.4 | 39.4 | 35.0 | 79.4 | 60.6 | 32.0 | 2.6 |
| 35 | P | 1229 | 2.1 | 1123 | 3 | 83.0 | 17.6 | 16.7 | 14.3 | 13.3 | 86.0 | 38.1 | 30.0 | 2.6 |
| 36 | Q | 1230 | 2.1 | 1155 | 3 | 71.4 | 25.0 | 13.3 | 38.5 | 27.5 | 81.4 | 55.4 | 35.0 | 2.9 |
| 37 | Q | 1240 | 2.6 | 1132 | 2 | 83.0 | 17.6 | 14.3 | 16.7 | 13.3 | 86.0 | 38.1 | 30.0 | 2.6 |
| 38 | R | 1240 | 2.4 | 1144 | 4 | 74.3 | 17.8 | 18.9 | 23.3 | 21.0 | 78.9 | 50.9 | 35.0 | 3.6 |
| 39 | R | 1228 | 2.5 | 1121 | 3 | 85.7 | 16.0 | 14.3 | 16.7 | 13.3 | 88.0 | 38.1 | 35.0 | 2.6 |
| 40 | S | 1266 | 2.6 | 1151 | 4 | 74.3 | 16.7 | 20.0 | 25.0 | 19.2 | 78.6 | 51.5 | 35.0 | 3.6 |

Underlines indicate that corresponding values are outside the scope of the present invention.

TABLE 6

| | | Finish rolling | | | | | | | Cooling after finish rolling | | | | | | | |
|---|---|---|---|---|---|---|---|---|---|---|---|---|---|---|---|---|
| | | | Finish rolling | Temperature before F1 bit-ing | F1 delivery side | F2 delivery side | F3 delivery side | F4 delivery side (finish rolling | Primary | Intermediate air cooling | | | Secondary | Tertiary cooling | Coiling | |
| Manufacturing No. | Kind of steel | T1 (° C.) | start temperature (° C.) | (° C.) | temperature (° C.) | temperature (° C.) | temperature (° C.) | completion) temperature (° C.) | cooling Average cooling rate (° C./s) | Start temperature (° C.) | End temperature (° C.) | Air cooling time (s) | cooling Average cooling rate (° C./s) | Average cooling rate (° C./s) | Coiling temperature (° C.) | Note |
| 21 | H | 922 | 1033 | 945 | 928 | 910 | 903 | 894 | 90 | 710 | 693 | 5.6 | 25 | 89 | 80 | Comparative Example |
| 22 | I | 933 | 1050 | 947 | 929 | 920 | 908 | 898 | 100 | 680 | 670 | 4.8 | 25 | 90 | 80 | Comparative Example |
| 23 | J | 927 | 1045 | 936 | 925 | 920 | 912 | 902 | 100 | 675 | 659 | 5.2 | 20 | 90 | 40 | Comparative Example |
| 24 | K | 931 | 1041 | 938 | 925 | 910 | 903 | 894 | 100 | 650 | 631 | 6.2 | 25 | 85 | 80 | Comparative Example |
| 25 | L | 934 | 1028 | 945 | 932 | 918 | 910 | 891 | 100 | 678 | 669 | 4.4 | 20 | 78 | 80 | Comparative Example |
| 26 | M | 927 | 1026 | 948 | 931 | 919 | 910 | 896 | 90 | 689 | 671 | 4.5 | 25 | 75 | 80 | Comparative Example |
| 27 | N | 909 | 1015 | 921 | 905 | 897 | 886 | 882 | 100 | 681 | 665 | 5.2 | 25 | 78 | 80 | Comparative Example |
| 28 | O | 954 | 1050 | 960 | 940 | 930 | 910 | 900 | 100 | 690 | 679 | 5.3 | 25 | 75 | 80 | Present Invention Example |
| 29 | O | 954 | 1064 | 965 | 955 | 941 | 925 | 913 | 90 | 677 | 669 | 4.2 | 21 | 90 | 40 | Present Invention Example |
| 30 | O | 954 | 1028 | 955 | 939 | 929 | 912 | 899 | 40 | 688 | 675 | 4.2 | 20 | 75 | 40 | Comparative Example |
| 31 | O | 954 | 1035 | 958 | 942 | 925 | 906 | 898 | 100 | 694 | 679 | 5.1 | 40 | 40 | 80 | Comparative Example |
| 32 | O | 954 | 1033 | 955 | 942 | 926 | 900 | 893 | 100 | 675 | 650 | 6.3 | 75 | 75 | 60 | Comparative Example |
| 33 | O | 954 | 1043 | 959 | 938 | 922 | 910 | 900 | 100 | 702 | 684 | 4.5 | 25 | 25 | 60 | Comparative Example |
| 34 | P | 925 | 1026 | 935 | 925 | 915 | 908 | 890 | 100 | 674 | 661 | 6.6 | 18 | 90 | 80 | Present Invention Example |
| 35 | P | 925 | 1021 | 935 | 920 | 914 | 905 | 891 | 90 | 703 | 692 | 5.6 | 25 | 90 | 40 | Present Invention Example |

TABLE 6-continued

| | | Finish rolling | | | | | | | Cooling after finish rolling | | | | | | | |
|---|---|---|---|---|---|---|---|---|---|---|---|---|---|---|---|---|
| | | | | | | | | | | Intermediate air cooling | | | | | | |
| Manufacturing No. | Kind of steel | T1 (° C.) | Finish rolling start temperature (° C.) | Temperature before F1 bitting (° C.) | F1 delivery side temperature (° C.) | F2 delivery side temperature (° C.) | F3 delivery side temperature (° C.) | F4 delivery side (finish rolling completion) temperature (° C.) | Primary cooling Average cooling rate (° C./s) | Start temperature (° C.) | End temperature (° C.) | Air cooling time (s) | Secondary cooling Average cooling rate (° C./s) | Tertiary cooling Average cooling rate (° C./s) | Coiling Coiling temperature (° C.) | Note |
| 36 | Q | 925 | 1045 | 941 | 933 | 921 | 908 | 900 | 100 | 685 | 671 | 7.2 | 20 | 80 | 80 | Present Invention Example |
| 37 | Q | 925 | 1031 | 931 | 919 | 910 | 902 | 890 | 90 | 685 | 671 | 3.6 | 26 | 77 | 40 | Present Invention Example |
| 38 | R | 934 | 1050 | 941 | 929 | 913 | 902 | 891 | 100 | 651 | 633 | 4.6 | 22 | 88 | 40 | Present Invention Example |
| 39 | R | 934 | 1045 | 942 | 929 | 915 | 906 | 897 | 90 | 701 | 674 | 5.5 | 19 | 80 | 80 | Present Invention Example |
| 40 | S | 945 | 1061 | 956 | 944 | 931 | 918 | 908 | 90 | 705 | 690 | 5.1 | 25 | 90 | 80 | Present Invention Example |

Underlines indicate that corresponding values are outside the scope of the present invention.

TABLE 7

| | | Slab heating | | Rough rolling | | Finish rolling | | | | | | | | |
|---|---|---|---|---|---|---|---|---|---|---|---|---|---|---|
| Manufacturing No. | Kind of steel | Heating temperature (° C.) | Holding time (h) | Finishing temperature (° C.) | Number of times of rolling with rolling reduction of 30% or larger (times) | Cumulative rolling reduction until F1 (%) | Rolling reduction of F1 (%) | Rolling reduction of F2 (%) | Rolling reduction of F3 (%) | Rolling reduction of F4 (%) | Cumulative rolling reduction at higher T1° C. or (%) | Cumulative rolling reduction at lower T1° C. or (%) | Sheet thickness at start of finish rolling (mm) | Sheet thickness at end of finish rolling (mm) |
| 41 | S | 1235 | 2.1 | 1115 | 3 | 80.3 | 15.9 | 13.8 | 18.0 | 11.3 | 83.4 | 37.3 | 35.0 | 3.6 |
| 42 | T | 1229 | 2.5 | 1125 | 3 | 61.7 | 30.4 | 21.3 | 27.0 | 21.0 | 79.0 | 42.3 | 30.0 | 3.6 |
| 43 | T | 1237 | 1.8 | 1122 | 3 | 79.4 | 23.6 | 14.5 | 12.8 | 11.3 | 86.6 | 22.7 | 35.0 | 3.6 |
| 44 | U | 1261 | 2.1 | 1133 | 4 | 69.3 | 18.5 | 17.3 | 35.5 | 27.5 | 79.3 | 53.2 | 30.0 | 2.9 |
| 45 | U | 1230 | 2.5 | 1142 | 4 | 75.7 | 25.9 | 23.8 | 14.6 | 11.3 | 86.3 | 24.3 | 35.0 | 3.6 |
| 46 | V | 1230 | 1.7 | 1128 | 3 | 71.4 | 25.0 | 13.3 | 38.5 | 27.5 | 81.4 | 55.4 | 35.0 | 2.9 |
| 47 | V | 1225 | 2.1 | 1144 | 3 | 81.3 | 19.6 | 15.6 | 13.2 | 12.1 | 85.0 | 35.6 | 30.0 | 2.9 |
| 48 | W | 1240 | 2.2 | 1135 | 4 | 73.4 | 19.4 | 20.0 | 25.0 | 19.2 | 78.6 | 51.5 | 35.0 | 3.6 |
| 49 | W | 1237 | 2.3 | 1136 | 3 | 80.0 | 21.4 | 14.5 | 12.8 | 11.3 | 84.3 | 33.9 | 35.0 | 3.6 |
| 50 | X | 1250 | 1.9 | 1131 | 3 | 68.1 | 22.5 | 16.5 | 39.4 | 35.0 | 79.4 | 60.6 | 32.0 | 2.6 |
| 51 | X | 1235 | 2.4 | 1142 | 4 | 80.6 | 20.6 | 13.0 | 12.8 | 11.3 | 84.6 | 32.7 | 35.0 | 3.6 |
| 52 | Y | 1235 | 2.5 | 1135 | 4 | 74.3 | 16.7 | 20.0 | 25.0 | 19.2 | 78.6 | 51.5 | 35.0 | 3.6 |
| 53 | Y | 1230 | 1.8 | 1145 | 3 | 83.3 | 16.0 | 14.3 | 16.7 | 13.3 | 86.0 | 38.1 | 30.0 | 2.6 |
| 54 | Z | 1228 | 2.2 | 1134 | 3 | 73.7 | 18.5 | 20.0 | 23.3 | 21.0 | 78.6 | 51.5 | 35.0 | 3.6 |
| 55 | Z | 1247 | 2.2 | 1148 | 3 | 80.6 | 20.6 | 13.0 | 12.8 | 11.3 | 86.6 | 22.7 | 35.0 | 3.6 |
| 56 | AA | 1261 | 2.3 | 1141 | 4 | 69.3 | 18.5 | 17.3 | 35.5 | 27.5 | 79.3 | 53.2 | 30.0 | 2.9 |
| 57 | AA | 1240 | 1.9 | 1144 | 3 | 81.3 | 19.6 | 15.6 | 13.2 | 12.1 | 87.3 | 23.7 | 30.0 | 2.9 |

TABLE 7-continued

| | | Slab heating | | Rough rolling | | Finish rolling | | | | | | | | |
|---|---|---|---|---|---|---|---|---|---|---|---|---|---|---|
| Manufacturing No. | Kind of steel | Heating temperature (° C.) | Holding time (h) | Finishing temperature (° C.) | Number of times of rolling with rolling reduction of 30% or larger (times) | Cumulative rolling reduction until F1 (%) | Rolling reduction of F1 (%) | Rolling reduction of F2 (%) | Rolling reduction of F3 (%) | Rolling reduction of F4 (%) | Cumulative rolling reduction at higher T1° C. or (%) | Cumulative rolling reduction at lower T1° C. or (%) | Sheet thickness at start of finish rolling (mm) | Sheet thickness at end of finish rolling (mm) |
| 58 | AB | 1268 | 2.8 | 1132 | 2 | 74.0 | 31.9 | 16.1 | 25.0 | 25.6 | 82.3 | 53.2 | 35.0 | 2.9 |
| 59 | AB | 1250 | 2.3 | 1146 | 4 | 80.6 | 20.6 | 13.0 | 12.8 | 11.3 | 86.6 | 22.7 | 35.0 | 3.6 |
| 60 | AC | 1230 | 2.1 | 1135 | 3 | 74.3 | 17.8 | 18.9 | 23.3 | 21.0 | 78.9 | 50.9 | 35.0 | 3.6 |

Underlines indicate that corresponding values are outside the scope of the present invention.

TABLE 8

| | | Finish rolling | | | | | | | Cooling after finish rolling | | | | | | | |
|---|---|---|---|---|---|---|---|---|---|---|---|---|---|---|---|---|
| Manufacturing No. | Kind of steel | T1 (° C.) | Finish rolling start temperature (° C.) | Temperature before F1 biting (° C.) | F1 delivery side temperature (° C.) | F2 delivery side temperature (° C.) | F3 delivery side temperature (° C.) | F4 delivery side (finish rolling completion) temperature (° C.) | Primary cooling Average cooling rate (° C./s) | Intermediate air cooling: Start temperature (° C.) | Intermediate air cooling: End temperature (° C.) | Intermediate air cooling: Air cooling time (s) | Secondary cooling Average cooling rate (° C./s) | Tertiary cooling Average cooling rate (° C./s) | Coiling Coiling temperature (° C.) | Note |
| 41 | S | 945 | 1055 | 951 | 940 | 932 | 919 | 908 | 85 | 689 | 676 | 6.3 | 18 | 75 | 80 | Present Invention Example |
| 42 | T | 923 | 1031 | 951 | 936 | 921 | 911 | 901 | 98 | 691 | 672 | 6.3 | 23 | 90 | 80 | Present Invention Example |
| 43 | T | 923 | 1044 | 933 | 925 | 909 | 900 | 892 | 90 | 651 | 630 | 4.2 | 19 | 70 | 60 | Present Invention Example |
| 44 | U | 928 | 1041 | 945 | 931 | 918 | 905 | 893 | 90 | 675 | 663 | 4.1 | 28 | 71 | 40 | Present Invention Example |
| 45 | U | 928 | 1046 | 934 | 922 | 913 | 902 | 896 | 90 | 678 | 667 | 5.3 | 21 | 75 | 60 | Present Invention Example |
| 46 | V | 926 | 1041 | 938 | 921 | 910 | 901 | 889 | 100 | 705 | 670 | 7.1 | 20 | 100 | 80 | Present Invention Example |
| 47 | V | 926 | 1064 | 935 | 921 | 911 | 902 | 891 | 90 | 695 | 676 | 6.3 | 20 | 80 | 80 | Present Invention Example |
| 48 | W | 927 | 1035 | 933 | 921 | 913 | 905 | 889 | 100 | 697 | 676 | 5.3 | 26 | 90 | 80 | Present Invention Example |
| 49 | W | 927 | 1044 | 934 | 921 | 908 | 899 | 889 | 90 | 673 | 641 | 6.5 | 22 | 85 | 60 | Present Invention Example |
| 50 | X | 931 | 1026 | 953 | 940 | 929 | 915 | 908 | 100 | 681 | 670 | 3.6 | 22 | 90 | 80 | Present Invention Example |
| 51 | X | 931 | 1048 | 938 | 924 | 911 | 900 | 893 | 85 | 685 | 674 | 3.6 | 20 | 75 | 80 | Present Invention Example |
| 52 | Y | 924 | 1025 | 931 | 919 | 906 | 896 | 889 | 100 | 670 | 662 | 4.0 | 25 | 75 | 40 | Present Invention Example |
| 53 | Y | 924 | 1031 | 929 | 917 | 911 | 904 | 895 | 90 | 674 | 665 | 4.4 | 22 | 90 | 80 | Present Invention Example |

TABLE 8-continued

| | | Finish rolling | | | | | | | Cooling after finish rolling | | | | | | | |
|---|---|---|---|---|---|---|---|---|---|---|---|---|---|---|---|---|
| | | | | | F1 | F2 | F3 | F4 delivery side | | Intermediate air cooling | | | | | Coil- | |
| Manufacturing No. | Kind of steel | T1 (° C.) | Finish rolling start temperature (° C.) | Temperature before F1 biting (° C.) | F1 delivery side temperature (° C.) | F2 delivery side temperature (° C.) | F3 delivery side temperature (° C.) | (finish rolling completion) temperature (° C.) | Primary cooling Average cooling rate (° C./s) | Start temperature (° C.) | End temperature (° C.) | Air cooling time (s) | Secondary cooling Average cooling rate (° C./s) | Tertiary cooling Average cooling rate (° C./s) | ing Coiling temperature (° C.) | Note |
| 54 | Z | 927 | 1021 | 929 | 914 | 904 | 895 | 879 | 100 | 694 | 683 | 5.6 | 28 | 75 | 40 | Present Invention Example |
| 55 | Z | 927 | 1047 | 942 | 931 | 920 | 909 | 894 | 80 | 674 | 648 | 5.2 | 21 | 85 | 60 | Present Invention Example |
| 56 | AA | 927 | 1049 | 951 | 931 | 917 | 908 | 897 | 90 | 703 | 694 | 2.9 | 21 | 80 | 80 | Present Invention Example |
| 57 | AA | 927 | 1060 | 945 | 935 | 922 | 913 | 900 | 85 | 690 | 660 | 7.6 | 22 | 80 | 80 | Present Invention Example |
| 58 | AB | 980 | 1095 | 994 | 981 | 965 | 944 | 918 | 90 | 675 | 650 | 5.1 | 28 | 90 | 80 | Present Invention Example |
| 59 | AB | 980 | 1101 | 989 | 980 | 961 | 942 | 919 | 85 | 685 | 653 | 6.5 | 18 | 75 | 80 | Present Invention Example |
| 60 | AC | 944 | 1035 | 951 | 935 | 921 | 911 | 905 | 85 | 681 | 668 | 6.3 | 25 | 80 | 60 | Present Invention Example |

Underlines indicate that corresponding values are outside the scope of the present invention.

TABLE 9

| | | Slab heating | | Rough rolling | | Finish rolling | | | | | | | | |
|---|---|---|---|---|---|---|---|---|---|---|---|---|---|---|
| Manufacturing No. | Kind of steel | Heating temperature (° C.) | Holding time (h) | Finishing temperature (° C.) | Number of times of rolling with rolling reduction of 30% or larger (times) | Cumulative rolling reduction until F1 (%) | Rolling reduction of F1 (%) | Rolling reduction of F2 (%) | Rolling reduction of F3 (%) | Rolling reduction of F4 (%) | Cumulative rolling reduction at higher T1° C. or (%) | Cumulative rolling reduction at lower T1° C. or (%) | Sheet thickness at start of finish rolling (mm) | Sheet thickness at end of finish rolling (mm) |
| 61 | AC | 1241 | 2.5 | 1138 | 3 | 81.3 | 19.6 | 15.6 | 13.2 | 12.1 | 85.0 | 35.6 | 30.0 | 2.9 |
| 62 | AC | 1244 | 2.5 | 1140 | 3 | 74.3 | 33.3 | 33.3 | 20.0 | 9.4 | 82.9 | 51.7 | 35.0 | 2.9 |
| 63 | AC | 1228 | 2.8 | 1146 | 4 | 74.3 | 30.0 | 36.5 | 20.0 | 9.4 | 82.0 | 54.0 | 35.0 | 2.9 |
| 64 | AD | 1226 | 2.3 | 1121 | 4 | 72.9 | 23.2 | 30.1 | 31.4 | 25.7 | 79.1 | 64.4 | 35.0 | 2.6 |
| 65 | AD | 1235 | 2.1 | 1146 | 3 | 80.0 | 21.4 | 14.5 | 12.8 | 11.3 | 84.3 | 33.9 | 35.0 | 3.6 |
| 66 | AE | 1237 | 2.5 | 1131 | 3 | 70.0 | 30.0 | 17.5 | 25.0 | 25.6 | 79.0 | 54.0 | 30.0 | 2.9 |
| 67 | AE | 1236 | 2.0 | 1134 | 3 | 80.6 | 19.1 | 14.5 | 12.8 | 11.3 | 84.3 | 33.9 | 35.0 | 3.6 |
| 68 | AF | 1247 | 1.9 | 1125 | 2 | 73.4 | 20.4 | 18.9 | 23.3 | 21.0 | 78.9 | 50.9 | 35.0 | 3.6 |
| 69 | AF | 1258 | 2.4 | 1119 | 4 | 81.3 | 19.6 | 15.6 | 13.2 | 12.1 | 85.0 | 35.6 | 30.0 | 2.9 |
| 70 | AG | 1246 | 2.0 | 1143 | 4 | 74.3 | 16.7 | 20.0 | 23.3 | 21.0 | 78.6 | 51.5 | 35.0 | 3.6 |
| 71 | AG | 1250 | 2.2 | 1123 | 4 | 81.1 | 15.2 | 16.1 | 12.8 | 11.3 | 84.0 | 35.1 | 35.0 | 3.6 |
| 72 | AH | 1236 | 2.2 | 1135 | 3 | 74.9 | 14.8 | 20.0 | 23.3 | 21.0 | 78.6 | 51.5 | 35.0 | 3.6 |
| 73 | AH | 1245 | 2.5 | 1141 | 3 | 73.7 | 32.6 | 16.1 | 25.0 | 25.6 | 82.3 | 53.2 | 35.0 | 2.9 |
| 74 | AI | 1231 | 1.5 | 1119 | 2 | 72.0 | 13.1 | 9.6 | 31.8 | 35.6 | 78.0 | 56.1 | 30.0 | 2.9 |
| 75 | AJ | 1253 | 4.2 | 1161 | 3 | 74.3 | 16.7 | 21.3 | 22.0 | 21.0 | 78.6 | 51.5 | 35.0 | 3.6 |
| 76 | A | 1243 | 1.5 | 1149 | 3 | 70.0 | 28.9 | 18.8 | 25.0 | 25.6 | 82.7 | 44.2 | 30.0 | 2.9 |
| 77 | A | 1248 | 1.5 | 1145 | 2 | 74.3 | 16.7 | 20.0 | 23.3 | 21.0 | 78.6 | 51.5 | 35.0 | 3.6 |
| 78 | D | 1234 | 1.8 | 1130 | 2 | 73.0 | 18.0 | 17.8 | 25.0 | 19.2 | 77.9 | 50.2 | 33.0 | 3.6 |

TABLE 9-continued

| | | Slab heating | | Rough rolling | | Finish rolling | | | | | | | | |
|---|---|---|---|---|---|---|---|---|---|---|---|---|---|---|
| Manufacturing No. | Kind of steel | Heating temperature (° C.) | Holding time (h) | Finishing temperature (° C.) | Number of times of rolling with rolling reduction of 30% or larger (times) | Cumulative rolling reduction until F1 (%) | Rolling reduction of F1 (%) | Rolling reduction of F2 (%) | Rolling reduction of F3 (%) | Rolling reduction of F4 (%) | Cumulative rolling reduction at higher T1° C. or (%) | Cumulative rolling reduction at lower T1° C. or (%) | Sheet thickness at start of finish rolling (mm) | Sheet thickness at end of finish rolling (mm) |
| 79 | E | 1245 | 1.8 | 1143 | 3 | 70.3 | 13.7 | 12.2 | 44.4 | 27.5 | 77.5 | 59.7 | 32.0 | 2.9 |
| 80 | E | 1249 | 2.5 | 1150 | 3 | 65.7 | 25.0 | 33.3 | 33.3 | 20.0 | 82.9 | 46.7 | 35.0 | 3.2 |
| 81 | F | 1242 | 2.0 | 1128 | 2 | 59.3 | 33.6 | 21.0 | 29.7 | 35.6 | 78.7 | 54.7 | 30.0 | 2.9 |

Underlines indicate that corresponding values are outside the scope of the present invention.

TABLE 10

| | | Finish rolling | | | | | | | Cooling after finish rolling | | | | | | | |
|---|---|---|---|---|---|---|---|---|---|---|---|---|---|---|---|---|
| Manufacturing No. | Kind of steel | T1 (° C.) | Finish rolling start temperature (° C.) | Temperature before F1 biting (° C.) | F1 delivery side temperature (° C.) | F2 delivery side temperature (° C.) | F3 delivery side temperature (° C.) | F4 delivery side (finish rolling completion) temperature (° C.) | Primary cooling Average cooling rate (° C./s) | Intermediate air cooling Start temperature (° C.) | Intermediate air cooling End temperature (° C.) | Intermediate air cooling Air cooling time (s) | Secondary cooling Average cooling rate (° C./s) | Tertiary cooling Average cooling rate (° C./s) | Coiling Coiling temperature (° C.) | Note |
| 61 | AC | 944 | 1072 | 951 | 939 | 930 | 919 | 905 | 90 | 667 | 630 | 7.5 | 20 | 90 | 80 | Present Invention Example |
| 62 | AC | 944 | 1059 | 951 | 936 | 927 | 917 | 902 | 90 | 680 | 658 | 4.5 | 70 | 70 | 40 | Comparative Example |
| 63 | AC | 944 | 1055 | 948 | 937 | 926 | 917 | 900 | 90 | 703 | 687 | 5.3 | 25 | 80 | 60 | Present Invention Example |
| 64 | AD | 946 | 1026 | 955 | 941 | 929 | 915 | 908 | 90 | 705 | 680 | 6.3 | 25 | 75 | 40 | Present Invention Example |
| 65 | AD | 946 | 1065 | 956 | 941 | 929 | 913 | 899 | 90 | 675 | 649 | 6.4 | 25 | 90 | 60 | Present Invention Example |
| 66 | AE | 929 | 1046 | 935 | 924 | 918 | 912 | 896 | 80 | 694 | 672 | 5.5 | 25 | 80 | 80 | Present Invention Example |
| 67 | AE | 929 | 1046 | 938 | 925 | 911 | 901 | 892 | 80 | 700 | 679 | 7.1 | 20 | 75 | 80 | Present Invention Example |
| 68 | AF | 927 | 1047 | 939 | 930 | 919 | 908 | 898 | 90 | 675 | 663 | 6.2 | 20 | 90 | 80 | Present Invention |
| 69 | AF | 927 | 1045 | 940 | 924 | 914 | 905 | 896 | 85 | 669 | 640 | 7.3 | 25 | 90 | 80 | Present Invention |
| 70 | AG | 924 | 1040 | 933 | 920 | 909 | 900 | 891 | 80 | 688 | 671 | 5.6 | 22 | 85 | 80 | Present Invention |
| 71 | AG | 924 | 1044 | 935 | 920 | 908 | 899 | 886 | 90 | 681 | 647 | 6.8 | 22 | 80 | 80 | Present Invention |
| 72 | AH | 950 | 1050 | 955 | 941 | 930 | 919 | 905 | 90 | 710 | 676 | 6.8 | 28 | 90 | 80 | Present Invention Example |
| 73 | AH | 950 | 1063 | 955 | 942 | 923 | 908 | 895 | 90 | 632 | 594 | 8 | 20 | 80 | 60 | Comparative Example |

TABLE 10-continued

| | | Finish rolling | | | | | | | Cooling after finish rolling | | | | | | Coil- | |
|---|---|---|---|---|---|---|---|---|---|---|---|---|---|---|---|---|
| | | | | | F1 | F2 | F3 | F4 delivery side | | Intermediate air cooling | | | | | | |
| Manufacturing No. | Kind of steel | T1 (° C.) | Finish rolling start temperature (° C.) | Temperature before F1 biting (° C.) | F1 delivery side temperature (° C.) | F2 delivery side temperature (° C.) | F3 delivery side temperature (° C.) | (finish rolling completion) temperature (° C.) | Primary cooling Average cooling rate (° C./s) | Start temperature (° C.) | End temperature (° C.) | Air cooling time (s) | Secondary cooling Average cooling rate (° C./s) | Tertiary cooling Average cooling rate (° C./s) | Coiling temperature (° C.) | Note |
| 74 | AI | 913 | 1025 | 931 | 918 | 906 | 892 | 884 | 90 | 652 | 644 | 4.2 | 25 | 85 | 60 | Present Invention Example |
| 75 | AJ | 940 | 1045 | 945 | 931 | 918 | 910 | 891 | 90 | 650 | 641 | 4.5 | 25 | 90 | 80 | Present Invention Example |
| 76 | A | 930 | 1049 | 950 | 925 | 912 | 900 | 879 | 100 | 655 | 648 | 1.7 | 25 | 80 | 90 | Comparative Example |
| 77 | A | 930 | 1042 | 945 | 927 | 915 | 900 | 890 | 90 | 675 | 669 | 2.8 | 25 | 80 | 150 | Comparative Example |
| 78 | D | 934 | 1042 | 943 | 928 | 919 | 904 | 893 | 90 | 675 | 661 | 14.0 | 25 | 85 | 90 | Comparative Example |
| 79 | E | 927 | 1033 | 951 | 928 | 917 | 908 | 896 | 95 | 648 | 642 | 2.8 | 22 | 65 | 75 | Present Invention Example |
| 80 | E | 927 | 1044 | 962 | 935 | 918 | 910 | 900 | 90 | 651 | 640 | 3.6 | 24 | 70 | 80 | Present Invention Example |
| 81 | F | 931 | 1055 | 949 | 937 | 925 | 915 | 903 | 80 | 743 | 736 | 3.5 | 25 | 80 | 80 | Comparative Example |

Underlines indicate that corresponding values are outside the scope of the present invention.

TABLE 11

| | | Microstructure | | | | | | | | | | | |
|---|---|---|---|---|---|---|---|---|---|---|---|---|---|
| Manufacturing No. | Kind of steel | Polygonal ferrite (area %) | Bainitic ferrite (area %) | Cementite, pearlite, fresh martensite, tempered martensite, and residual austenite (area %) | Correlation value | Maximum probability value ($\times 10^{-3}$) | Tensile strength TS (MPa) | Yield ratio YR | Total elongation EL (%) | R/t | $vE_{-100}$ ($J/cm^2$) | Presence or absence of scale pattern | Note |
| 1 | A | 8.0 | 90.6 | 1.4 | 0.85 | 5.5 | 802 | 0.87 | 19.5 | 0.7 | 127 | OK | Present Invention Example |
| 2 | A | 8.3 | 91.2 | 0.5 | 0.87 | 8.3 | 815 | 0.89 | 20.5 | 0.3 | 145 | OK | Present Invention Example |
| 3 | A | 4.3 | 92.9 | 2.8 | 0.86 | 2.5 | 806 | 0.87 | 18.6 | 1.3 | 111 | OK | Comparative Example |
| 4 | A | 8.2 | 89.4 | 2.4 | 0.86 | 2.4 | 821 | 0.90 | 21.1 | 1.1 | 116 | OK | Comparative Example |
| 5 | B | 8.0 | 89.8 | 2.2 | 0.83 | 6 | 782 | 0.88 | 20.1 | 0.7 | 124 | OK | Present Invention Example |
| 6 | B | 7.3 | 92.5 | 0.2 | 0.86 | 9.3 | 799 | 0.89 | 22.5 | 0.1 | 142 | OK | Present Invention Example |
| 7 | B | 6.5 | 90.9 | 2.6 | 0.84 | 3.6 | 802 | 0.88 | 21.5 | 1.0 | 115 | OK | Comparative Example |
| 8 | B | 28.0 | 72.0 | 0.0 | Not measured | Not measured | 678 | 0.86 | 29.5 | 0.6 | 115 | OK | Comparative Example |

TABLE 11-continued

| Manufacturing No. | Kind of steel | Microstructure: Polygonal ferrite (area %) | Bainitic ferrite (area %) | Cementite, pearlite, fresh martensite, tempered martensite, and residual austenite (area %) | Correlation value | Maximum probability value ($\times 10^{-3}$) | Tensile strength TS (MPa) | Yield ratio YR | Total elongation EL (%) | R/t | $vE_{-100}$ (J/cm$^2$) | Presence or absence of scale pattern | Note |
|---|---|---|---|---|---|---|---|---|---|---|---|---|---|
| 9 | C | 5.3 | 92.7 | 2.0 | 0.86 | 5.2 | 811 | 0.91 | 18.6 | 0.6 | 131 | OK | Present Invention Example |
| 10 | C | 5.1 | 94.6 | 0.3 | 0.85 | 9.4 | 804 | 0.89 | 20.3 | 0.3 | 140 | OK | Present Invention Example |
| 11 | C | 7.6 | 91.9 | 0.5 | 0.86 | 3.6 | 811 | 0.90 | 18.6 | 1.1 | 106 | OK | Comparative Example |
| 12 | C | 1.3 | 97.3 | 1.4 | 0.96 | 4.2 | 844 | 0.84 | 17.3 | 0.7 | 121 | OK | Comparative Example |
| 13 | D | 8.3 | 89.4 | 2.3 | 0.83 | 4.8 | 796 | 0.88 | 21.2 | 0.7 | 125 | OK | Present Invention Example |
| 14 | D | 8.9 | 90.0 | 1.1 | 0.76 | 5.2 | 745 | 0.84 | 22.5 | 0.5 | 131 | OK | Comparative Example |
| 15 | E | 6.5 | 91.2 | 2.3 | 0.83 | 6.1 | 803 | 0.88 | 20.6 | 0.5 | 141 | OK | Present Invention Example |
| 16 | E | 8.2 | 90.7 | 1.1 | 0.84 | 2.9 | 788 | 0.89 | 20.2 | 1.0 | 115 | OK | Comparative Example |
| 17 | F | 7.7 | 90.4 | 1.9 | 0.84 | 5.8 | 796 | 0.87 | 22.1 | 0.7 | 129 | OK | Present Invention Example |
| 18 | F | 38.0 | 61.5 | 0.5 | Not measured | Not measured | 698 | 0.86 | 26.5 | 0.4 | 110 | OK | Comparative Example |
| 19 | F | 7.5 | 90.4 | 2.1 | 0.84 | 3.5 | 798 | 0.89 | 19.8 | 1.2 | 112 | OK | Comparative Example |
| 20 | G | 5.1 | 93.3 | 1.6 | 0.85 | 3.4 | 810 | 0.88 | 19.1 | 1.1 | 108 | OK | Comparative Example |

Underlines indicate that corresponding values are outside the scope of the present invention.

TABLE 12

| Manufacturing No. | Kind of steel | Microstructure: Polygonal ferrite (area %) | Bainitic ferrite (area %) | Cementite, pearlite, fresh martensite, tempered martensite, and residual austenite (area %) | Correlation value | Maximum probability value ($\times 10^{-3}$) | Tensile strength TS (MPa) | Yield ratio YR | Total elongation EL (%) | R/t | $vE_{-100}$ (J/cm$^2$) | Presence or absence of scale pattern | Note |
|---|---|---|---|---|---|---|---|---|---|---|---|---|---|
| 21 | H | 28.0 | 69.9 | 2.1 | | | 699 | 0.89 | 26.4 | 0.5 | 110 | OK | Comparative Example |
| 22 | I | 8.5 | 90.5 | 1.0 | 0.85 | 6.2 | 822 | 0.87 | 20.2 | 0.6 | 129 | NG | Comparative Example |
| 23 | J | 9.4 | 88.7 | 1.9 | 0.79 | 6.3 | 771 | 0.85 | 23.1 | 0.6 | 142 | OK | Comparative Example |
| 24 | K | 5.4 | 93.6 | 1.0 | 0.84 | 3.2 | 805 | 0.87 | 18.6 | 1.2 | 115 | OK | Comparative Example |
| 25 | L | 5.1 | 92.8 | 2.1 | 0.83 | 3.1 | 799 | 0.87 | 21.2 | 1.1 | 113 | OK | Comparative Example |
| 26 | M | 8.6 | 90.0 | 1.4 | 0.76 | 5.1 | 761 | 0.81 | 22.5 | 0.6 | 129 | OK | Comparative Example |
| 27 | N | 7.1 | 90.3 | 2.6 | 0.84 | 4.5 | 778 | 0.85 | 21.1 | 0.7 | 121 | OK | Comparative Example |
| 28 | O | 7.0 | 91.6 | 1.4 | 0.84 | 6 | 803 | 0.88 | 20.1 | 0.6 | 136 | OK | Present Invention Example |
| 29 | O | 6.5 | 93.1 | 0.4 | 0.84 | 10.1 | 800 | 0.89 | 21.2 | 0.2 | 147 | OK | Present Invention Example |

TABLE 12-continued

| Manufacturing No. | Kind of steel | Microstructure: Polygonal ferrite (area %) | Bainitic ferrite (area %) | Cementite, pearlite, fresh martensite, tempered martensite, and residual austenite (area %) | Correlation value | Maximum probability value ($\times 10^{-3}$) | Tensile strength TS (MPa) | Yield ratio YR | Total elongation EL (%) | R/t | $vE_{-100}$ ($J/cm^2$) | Presence or absence of scale pattern | Note |
|---|---|---|---|---|---|---|---|---|---|---|---|---|---|
| 30 | O | 67.0 | 31.8 | 1.2 | Not measured | Not measured | 622 | 0.82 | 31.1 | 0.3 | 105 | OK | Comparative Example |
| 31 | O | 6.3 | 92.2 | 1.5 | 0.84 | 2.4 | 801 | 0.87 | 18.6 | 1.3 | 103 | OK | Comparative Example |
| 32 | O | 7.1 | 91.0 | 1.9 | 0.85 | 3.7 | 805 | 0.89 | 19.4 | 1.1 | 113 | OK | Comparative Example |
| 33 | O | 6.8 | 92.6 | 0.7 | 0.84 | 3.1 | 800 | 0.88 | 19.1 | 1.1 | 108 | OK | Comparative Example |
| 34 | P | 6.1 | 92.8 | 1.1 | 0.86 | 6.1 | 821 | 0.91 | 18.5 | 0.6 | 129 | OK | Present Invention Example |
| 35 | P | 6.4 | 93.1 | 0.5 | 0.85 | 9.3 | 811 | 0.90 | 18.9 | 0.2 | 140 | OK | Present Invention Example |
| 36 | Q | 7.2 | 92.3 | 0.5 | 0.85 | 6.5 | 818 | 0.90 | 20.5 | 0.7 | 130 | OK | Present Invention Example |
| 37 | O | 7.3 | 92.4 | 0.3 | 0.88 | 10.3 | 817 | 0.89 | 21.1 | 0.2 | 142 | OK | Present Invention Example |
| 38 | R | 6.3 | 92.6 | 1.1 | 0.83 | 4.9 | 815 | 0.89 | 18.4 | 0.7 | 129 | OK | Present Invention Example |
| 39 | R | 4.2 | 94.8 | 1.0 | 0.86 | 9.6 | 816 | 0.87 | 19.6 | 0.2 | 144 | OK | Present Invention Example |
| 40 | S | 5.5 | 92.4 | 2.1 | 0.83 | 6.2 | 811 | 0.86 | 19.4 | 0.6 | 139 | OK | Present Invention Example |

TABLE 13

| Manufacturing No. | Kind of steel | Microstructure: Polygonal ferrite (area %) | Bainitic ferrite (area %) | Cementite, pearlite, fresh martensite, tempered martensite, and residual austenite (area %) | Correlation value | Maximum probability value ($\times 10^{-3}$) | Tensile strength TS (MPa) | Yield ratio YR | Total elongation EL (%) | R/t | $vE_{-100}$ ($J/cm^2$ | Presence or absence of scale pattern | Note |
|---|---|---|---|---|---|---|---|---|---|---|---|---|---|
| 41 | S | 7.3 | 91.1 | 1.6 | 0.87 | 10.6 | 806 | 0.90 | 21.1 | 0.1 | 145 | OK | Present Invention Example |
| 42 | T | 6.1 | 92.9 | 1.0 | 0.84 | 5.8 | 795 | 0.89 | 21.1 | 0.6 | 131 | OK | Present Invention Example |
| 43 | T | 7.5 | 91.7 | 0.8 | 0.84 | 8.8 | 812 | 0.88 | 22.1 | 0.3 | 141 | OK | Present Invention Example |
| 44 | U | 6.3 | 92.3 | 1.4 | 0.86 | 5.1 | 810 | 0.87 | 19.5 | 0.7 | 123 | OK | Present Invention Example |
| 45 | U | 8.2 | 89.5 | 2.3 | 0.85 | 9.1 | 805 | 0.88 | 19.6 | 0.3 | 142 | OK | Present Invention Example |
| 46 | V | 8.1 | 90.9 | 1.0 | 0.85 | 5.1 | 804 | 0.89 | 20.4 | 0.7 | 135 | OK | Present Invention Example |
| 47 | V | 8.4 | 89.1 | 2.5 | 0.86 | 10.5 | 821 | 0.91 | 18.6 | 0.2 | 144 | OK | Present Invention Example |

TABLE 13-continued

| Manufacturing No. | Kind of steel | Microstructure: Polygonal ferrite (area %) | Bainitic ferrite (area %) | Cementite, pearlite, fresh martensite, tempered martensite, and residual austenite (area %) | Correlation value | Maximum probability value ($\times 10^{-3}$) | Tensile strength TS (MPa) | Yield ratio YR | Total elongation EL (%) | R/t | $vE_{-100}$ (J/cm$^2$) | Presence or absence of scale pattern | Note |
|---|---|---|---|---|---|---|---|---|---|---|---|---|---|
| 48 | W | 7.2 | 92.1 | 0.7 | 0.86 | 6.3 | 815 | 0.89 | 21.1 | 0.6 | 130 | OK | Present Invention Example |
| 49 | W | 7.8 | 91.4 | 0.8 | 0.90 | 8.4 | 822 | 0.90 | 20.5 | 0.3 | 141 | OK | Present Invention Example |
| 50 | X | 7.6 | 91.0 | 1.4 | 0.87 | 5.9 | 823 | 0.89 | 19.7 | 0.6 | 139 | OK | Present Invention Example |
| 51 | X | 6.5 | 92.3 | 1.2 | 0.85 | 10.3 | 810 | 0.90 | 20.4 | 0.1 | 142 | OK | Present Invention Example |
| 52 | Y | 8.1 | 90.6 | 1.3 | 0.85 | 5.3 | 799 | 0.87 | 24.0 | 0.7 | 127 | OK | Present Invention Example |
| 53 | Y | 8.1 | 91.0 | 0.9 | 0.84 | 11.5 | 789 | 0.87 | 19.9 | 0.2 | 144 | OK | Present Invention Example |
| 54 | Z | 7.5 | 90.2 | 2.3 | 0.85 | 5.7 | 803 | 0.91 | 19.6 | 0.6 | 133 | OK | Present Invention Example |
| 55 | Z | 7.6 | 91.5 | 0.9 | 0.88 | 12.5 | 846 | 0.90 | 19.0 | 0.1 | 146 | OK | Present Invention Example |
| 56 | AA | 6.9 | 92.7 | 0.4 | 0.84 | 7.1 | 789 | 0.87 | 21.4 | 0.7 | 139 | OK | Present Invention Example |
| 57 | AA | 8.6 | 90.7 | 0.7 | 0.86 | 11.8 | 815 | 0.90 | 21.1 | 0.2 | 143 | OK | Present Invention Example |
| 58 | AB | 8.5 | 89.6 | 1.9 | 0.86 | 6.8 | 889 | 0.87 | 17.6 | 0.7 | 124 | OK | Present Invention Example |
| 59 | AB | 6.5 | 92.8 | 0.7 | 0.87 | 10.5 | 893 | 0.92 | 17.5 | 0.4 | 140 | OK | Present Invention Example |
| 60 | AC | 6.1 | 93.2 | 0.7 | 0.84 | 5.9 | 801 | 0.89 | 19.6 | 0.7 | 134 | OK | Present Invention Example |

Underlines indicate that corresponding values are outside the scope of the present invention.

TABLE 14

| Manufacturing No. | Kind of steel | Microstructure: Polygonal ferrite (area %) | Bainitic ferrite (area %) | Cementite, pearlite, fresh martensite, tempered martensite, and residual austenite (area %) | Correlation value | Maximum probability value ($\times 10^{-3}$) | Tensile strength TS (MPa) | Yield ratio YR | Total elongation EL (%) | R/t | $vE_{-100}$ (J/cm$^2$) | Presence or absence of scale pattern | Note |
|---|---|---|---|---|---|---|---|---|---|---|---|---|---|
| 61 | AC | 7.5 | 91.8 | 0.7 | 0.87 | 9.8 | 821 | 0.90 | 19.9 | 0.3 | 142 | OK | Present Invention Example |
| 62 | AC | 7.8 | 89.9 | 2.3 | 0.85 | 3.3 | 790 | 0.89 | 20.8 | 0.9 | 117 | OK | Comparative Example |
| 63 | AC | 8.2 | 89.3 | 2.5 | 0.86 | 4.5 | 810 | 0.88 | 19.9 | 0.7 | 131 | OK | Present Invention Example |

TABLE 14-continued

| Manufacturing No. | Kind of steel | Microstructure: Polygonal ferrite (area %) | Bainitic ferrite (area %) | Cementite, pearlite, fresh martensite, tempered martensite, and residual austenite (area %) | Correlation value | Maximum probability value ($\times 10^{-3}$) | Tensile strength TS (MPa) | Yield ratio YR | Total elongation EL (%) | R/t | $vE_{-100}$ ($J/cm^2$) | Presence or absence of scale pattern | Note |
|---|---|---|---|---|---|---|---|---|---|---|---|---|---|
| 64 | AD | 8.2 | 89.5 | 2.3 | 0.85 | 6.1 | 811 | 0.89 | 21.1 | 0.6 | 131 | OK | Present Invention Example |
| 65 | AD | 7.6 | 91.5 | 0.9 | 0.86 | 10.1 | 833 | 0.90 | 19.5 | 0.1 | 142 | OK | Present Invention Example |
| 66 | AE | 7.4 | 91.5 | 1.1 | 0.84 | 5.5 | 811 | 0.89 | 21.1 | 0.7 | 134 | OK | Present Invention Example |
| 67 | AE | 8.2 | 91.5 | 0.3 | 0.88 | 10.5 | 821 | 0.90 | 20.3 | 0.3 | 143 | OK | Present Invention Example |
| 68 | AF | 6.5 | 92.4 | 1.1 | 0.86 | 6.6 | 821 | 0.89 | 22.0 | 0.7 | 135 | OK | Present Invention Example |
| 69 | AF | 6.7 | 91.9 | 1.4 | 0.87 | 8.9 | 815 | 0.89 | 19.6 | 0.3 | 141 | OK | Present Invention Example |
| 70 | AG | 7.5 | 91.3 | 1.2 | 0.84 | 5.6 | 808 | 0.89 | 21.3 | 0.6 | 133 | OK | Present Invention Example |
| 71 | AG | 5.9 | 92.9 | 1.2 | 0.86 | 8.5 | 809 | 0.89 | 18.9 | 0.1 | 141 | OK | Present Invention Example |
| 72 | AH | 35.0 | 65.0 | 0.0 | Not measured | Not measured | 718 | 0.88 | 25.4 | 0.4 | 106 | OK | Comparative Example |
| 73 | AH | 6.5 | 90.5 | 3.0 | 0.84 | 3.5 | 795 | 0.88 | 25.4 | 1.0 | 115 | OK | Comparative Example |
| 74 | AI | 6.0 | 92.1 | 1.9 | 0.84 | 4.8 | 789 | 0.86 | 20.5 | 0.7 | 126 | OK | Present Invention Example |
| 75 | AJ | 6.5 | 92.1 | 1.4 | 0.85 | 6.3 | 810 | 0.90 | 18.5 | 0.6 | 134 | OK | Present Invention Example |
| 76 | A | 3.6 | 93.9 | 2.5 | 0.85 | 3.0 | 815 | 0.86 | 18.1 | 1.2 | 115 | OK | Comparative Example |
| 77 | A | 4.5 | 92.8 | 2.7 | 0.86 | 2.3 | 808 | 0.89 | 20.5 | 1.3 | 113 | OK | Comparative Example |
| 78 | D | 14.0 | 85.2 | 0.8 | Not measured | Not measured | 757 | 0.85 | 27.5 | 0.6 | 117 | OK | Comparative Example |
| 79 | E | 2.4 | 95.7 | 1.9 | 0.85 | 4.9 | 821 | 0.87 | 19.5 | 0.7 | 131 | OK | Present Invention Example |
| 80 | E | 2.8 | 96.4 | 0.8 | 0.89 | 8.1 | 811 | 0.89 | 21.0 | 0.3 | 140 | OK | Present Invention Example |
| 81 | F | 16.0 | 82.6 | 1.5 | Not measured | Not measured | 739 | 0.88 | 27.8 | 0.7 | 118 | OK | Comparative Example |

Underlines indicate that corresponding values are outside the scope of the present invention.

From Tables 11 to 14, it is found that the hot rolled steel sheets according to the present invention examples had high strength and yield ratio and excellent ductility, bendability, toughness, and external appearance. In addition, it is found that, among the present invention examples, the hot rolled steel sheets with a maximum probability value of 0.0080 or more had superior bendability.

On the other hand, it is found that the hot rolled steel sheets according to the comparative examples did not have any one or more of high strength and yield ratio and excellent ductility, bendability, toughness, and external appearance.

INDUSTRIAL APPLICABILITY

According to the above-described aspect of the present invention, it is possible to provide a hot rolled steel sheet having high strength and yield ratio and being excellent in terms of ductility, bendability, toughness, and external appearance. In addition, according to the above-described preferable aspect of the present invention, it is possible to provide a hot rolled steel sheet having superior bendability.

What is claimed is:

1. A hot rolled steel sheet comprising, by mass %, as a chemical composition:

C: 0.025% to 0.055%,

Mn: 1.00% to 2.00%, sol. Al: 0.200% or more and less than 0.500%,
Ti: 0.030% to 0.200%,
Si: 0.100% or less,
P: 0.100% or less,
S: 0.030% or less,
N: 0.100% or less,
O: 0.010% or less,
Nb: 0% to 0.050%,
V: 0% to 0.050%,
Cu: 0% to 2.00%,
Cr: 0% to 2.00%,
Mo: 0% to 1.000%,
Ni: 0% to 2.00%,
B: 0% to 0.0100%,
Ca: 0% to 0.0200%,
Mg: 0% to 0.0200%,
REM: 0% to 0.1000%,
Bi: 0% to 0.0200%,
Zr: 0% to 1.000%,
Co: 0% to 1.000%,
Zn: 0% to 1.000%,
W: 0% to 1.000%,
Sn: 0% to 0.050%, and
a remainder: Fe and impurities,
wherein a microstructure contains, by area %,
polygonal ferrite: 2.0% or more and less than 10.0%, and
a remainder in the microstructure: 87.0% to 98.0% bainitic ferrite, and 0% to 3.0% cementite, pearlite, fresh martensite, tempered martensite, and residual austenite, and
a correlation value represented by the following formula (1), which is obtained by analyzing the remainder in the microstructure in a SEM image of the microstructure by a gray-level co-occurrence matrix method, is 0.82 to 0.95, and a maximum probability value represented by the following formula (2) is 0.0040 to 0.0200, $$\text{Correlation} = \sum_i \sum_j \frac{P(i, j)[(i - \mu_x) \cdot (j - \mu_y)]}{\sigma_x \sigma_y}, \quad (1)$$

$$\text{Maximum Probability} = \text{Max}(P(i, j)) \quad (2)$$

where P(i, j) in the formula (1) and the formula (2) is a gray-level co-occurrence matrix, and μx, μy, σx, and σy are represented by the following formulas (3) to (6), $$\mu_x = \sum_i \sum_j i(P(i, j)) \quad (3)$$

$$\mu_y = \sum_i \sum_j j(P(i, j)) \quad (4)$$

$$\sigma_x = \sum_i \sum_j P(i, j)(i - \mu_x)^2 \quad (5)$$

$$\sigma_y = \sum_i \sum_j P(i, j)(i - \mu_y)^2. \quad (6)$$

2. The hot rolled steel sheet according to claim 1, comprising, as the chemical composition, by mass %, one or more of:
Nb: 0.001% to 0.050%,
V: 0.001% to 0.050%,
Cu: 0.01% to 2.00%,
Cr: 0.01% to 2.00%,
Mo: 0.001% to 1.000%,
Ni: 0.01% to 2.00%,
B: 0.0001% to 0.0100%,
Ca: 0.0001% to 0.0200%,
Mg: 0.0001% to 0.0200%,
REM: 0.0001% to 0.1000%,
Bi: 0.0001% to 0.0200%,
Zr: 0.001% to 1.000%,
Co: 0.001% to 1.000%,
Zn: 0.001% to 1.000%,
W: 0.001% to 1.000%, and
Sn: 0.001% to 0.050%.

3. The hot rolled steel sheet according to claim 1,
wherein the maximum probability value of the microstructure is 0.0080 to 0.0200.

4. The hot rolled steel sheet according to claim 1,
wherein the chemical composition satisfies Si+[T-Al] <0.500% when a Si content by mass % is represented by Si, and an Al content by mass % is represented by [T-Al].

5. The hot rolled steel sheet according to claim 1,
wherein a tensile strength is 780 MPa or more, and
a yield ratio that is obtained by dividing a yield stress by the tensile strength is 0.86 or more.

6. The hot rolled steel sheet according to claim 2,
wherein the maximum probability value of the microstructure is 0.0080 to 0.0200.

* * * * *